US010079450B2

(12) United States Patent
Gang et al.

(10) Patent No.: US 10,079,450 B2
(45) Date of Patent: Sep. 18, 2018

(54) CONNECTOR HAVING HIGH VIBRATION RESISTANCE AND DURABILITY

(71) Applicant: J.S.T. Mfg. Co., Ltd., Osaka-shi, Osaka (JP)

(72) Inventors: Ho Jin Gang, Gyeonggi-do (KR); Shinya Masada, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 1 day.

(21) Appl. No.: 15/498,523

(22) Filed: Apr. 27, 2017

(65) Prior Publication Data

US 2017/0373437 A1 Dec. 28, 2017

(30) Foreign Application Priority Data

Jun. 22, 2016 (JP) ..... 2016-123267

(51) Int. Cl.
*H01R 13/62* (2006.01)
*H01R 13/629* (2006.01)
*H01R 13/516* (2006.01)

(52) U.S. Cl.
CPC ..... *H01R 13/62938* (2013.01); *H01R 13/516* (2013.01); *H01R 13/62955* (2013.01)

(58) Field of Classification Search
CPC ..... H01R 13/62955; H01R 13/516; H01R 13/62938
USPC ..... 439/157, 372, 752
See application file for complete search history.

(56) References Cited

U.S. PATENT DOCUMENTS

2010/0151742 A1* 6/2010 Shindo ..... H01R 13/533 439/650
2014/0113471 A1* 4/2014 Shimizu ..... H01R 13/743 439/157
2015/0011106 A1* 1/2015 Kamiya ..... H01R 13/62955 439/157
2015/0295352 A1* 10/2015 Kim ..... H01R 13/62938 439/157
2016/0172788 A1* 6/2016 Iida ..... H01R 13/62938 439/157

FOREIGN PATENT DOCUMENTS

JP 2008-071678 A1 3/2008

* cited by examiner

*Primary Examiner* — Abdullah Riyami
*Assistant Examiner* — Nelson R Burgos-Guntin
(74) *Attorney, Agent, or Firm* — Kratz, Quintos & Hanson, LLP

(57) ABSTRACT

Provided is a connector including first and second connector members connected to each other. The first connector member is formed with a protrusion. The second connector member includes a lever member rotatably provided thereto. The lever member is formed with at least one claw-shaped part configured to lock the protrusion. When connecting the first and second connector members, the lever member is rotated so that the protrusion locked in the claw-shaped part of the lever member is drawn in a connecting direction, and the first and second connector members are moved in the connecting direction and brought into contact with each other. After the movement is restrained, the lever member is further rotated so that the lever member is fixed while being elastically deformed.

4 Claims, 19 Drawing Sheets

CONNECTOR HAVING HIGH VIBRATION RESISTANCE AND DURABILITY

BACKGROUND

Technical Field

The present invention relates to a connector configured to restrain wobbles of connected connectors and have high vibration resistance and durability.

Related Art

For example, the following JP 2008-071678 A discloses an invention relating to a connector having vibration resistance. According to the invention disclosed in JP 2008-071678 A, the connector includes a female first housing, a male second housing, and a hook. The female first housing is configured to support a first connection terminal. The male second housing is configured to support a second connection terminal electrically connected to the first connection terminal and is configured to be inserted into the first housing so as to fit together with the first housing. The hook is hooked on a groove formed in the first housing, stretching along a direction perpendicular to a direction in which the first and second housings are fitted. The hook is also configured to press the second housing along either of a direction perpendicular to the fitting direction and to a direction toward the groove. One of the first and second housings is stretching in the fitting direction and includes a taper-shaped slit rib formed based on a predetermined rate-of-change of width and a predetermined rate-of-change of angle. The other one of the first and second housings is provided to a position corresponding to the slit rib and is stretching along the fitting direction of the first and second housings. The other one of the first and second housings also includes a taper-shaped groove having a rate-of-change of angle and a rate-of-change of width larger than the predetermined rate-of-change of width and the predetermined rate-of-change of angle of the slit rib. When the second housing is fitted with the first housing, an outer wall surface of the slit rib is inserted into an inner periphery of the groove, which makes a slit of the slit rib narrow so that the slit rib is forcibly inserted into the groove.

SUMMARY

In a connector according to the invention disclosed in JP 2008-071678 A, a hook is used to keep a first housing fitted together with a second housing. This hook penetrates fixing grooves of the first and second housings and presses an inclined surface so as to fix the first and second housings.

However, in the connector disclosed in JP 2008-071678 A, a metallic hook is employed so that manufacturing costs may increase, which is a problem to be solved. Since the first and second housings are fixed by elasticity of the hook, there is a possibility that those housings may come off under large pressure.

An object of the present invention is to provide a connector configured to restrain wobbles of connected connectors and have high vibration resistance and durability.

In order to solve the problem mentioned above, a connector according to a first aspect of the present invention includes:

a first connector member; and a second connector member, wherein the first connector member and the second connector member are connected to each other, the first connector member being formed with one or more protrusions, and the second connector member including a lever member rotatably provided to the second connector member, wherein the lever member is formed with one or more claw-shaped parts configured to lock the protrusions formed in the first connector member, wherein when connecting the first connector member and the second connector member, the lever member is rotated so that the protrusions locked in the claw-shaped parts of the lever member are drawn in a connecting direction, and the first connector member and the second connector member are moved in the connecting direction and at least partially brought into contact with each other, and wherein after the movement of the first connector member and the second connector member is restrained, the lever member is further rotated so that the lever member is fixed while at least a part of the lever member is elastically deformed.

In regard to a connector according to a second aspect, in the connector of the first aspect, the lever member includes a lock unit configured to be fixed in the second connector member, wherein when the first connector member and the second connector member are brought into contact with each other, the lock unit of the lever member is disposed in a position separated from a position where the lock unit is to be fixed in the second connector member, and the lever member is further rotated and elastically deformed so that the lock unit is fixed in the second connector member.

In regard to a connector according to a third aspect, in the connector of the first aspect, the first connector member includes a first housing body; and a fitting unit protruded from the first housing body, having a tubular shape, and formed in a surface where each protrusion faces the second connector member, the second connector member includes a second housing; and a hood member configured to cover the second housing, wherein when the first connector member and second connector member are connected, the first housing body and the second housing are at least partially brought into contact with each other so that the fitting unit of the first housing is fitted in a space between the second housing and the hood member.

In regard to a connector according to a fourth aspect, in the connector of the third aspect, the lever member includes:

an operation part formed with the lock unit, having a predetermined length;

a pair of arms stretching from both ends of the operation part;

a shaft disposed in each of the pair of arms; and a claw-shaped part disposed in each shaft, wherein the shafts of the lever member are rotatably provided to bearings configured to penetrate opposing surfaces of the hood member, and the claw-shaped parts are disposed in spaces formed between the second housing and the hood member.

According to the connector of the first aspect, the first and second connector members are fixed while the lever member configured to fix the first and second connector members is elastically deformed so that the second connector member constantly presses the first connector member due to force, a property of returning to its original size and shape, of the elastically deformed lever member. Therefore, it is possible to restrain wobbles and to achieve high durability and vibration resistance.

According to the connector of the second aspect, the lever member is elastically deformed so that it is not necessary to form a specific structure. Therefore, it is possible to reduce production costs and to reduce manufacturing processes.

According to the connector of the third aspect, the fitting unit formed in the first housing body of the first connector member is fitted with the space between the second housing of the second connector member and the hood member. Therefore, it is possible to downsize the connector.

According to the connector of the fourth aspect, the shafts of the lever member are configured to penetrate the bearings formed in the second housing so that the lever member is disposed in a substantially central part of the hood member. Therefore, it is possible to downsize the connector.

DETAILED DESCRIPTION

An embodiment of the present invention will now be described with reference to the accompanying drawings. Note that the following embodiment is to illustrate a connector for embodying a technical idea of the present invention and that the present invention should not be restricted thereto. The present invention is similarly applicable to other embodiments within the scope of the claims.

Embodiments

Figure 1A:
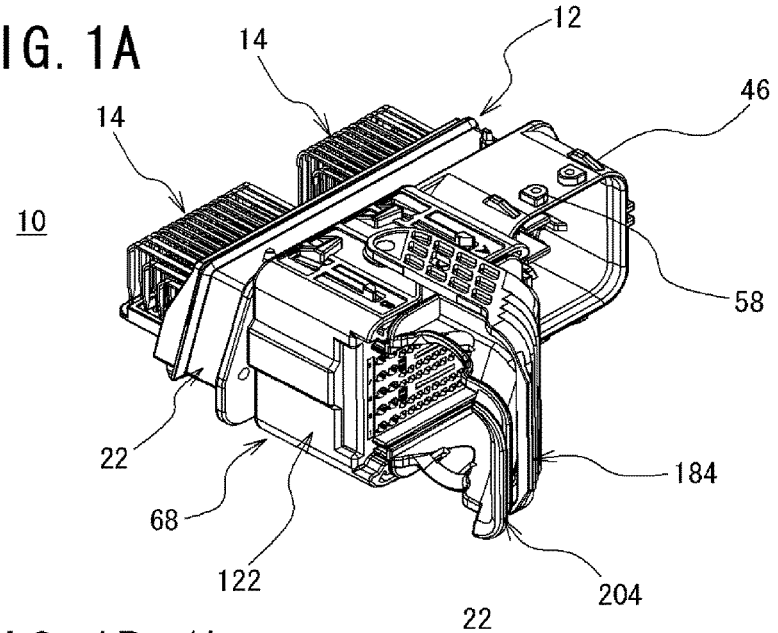
FIG. 1A is a perspective view of a connector according to an embodiment in such a state that first and second connector members are connected to the connector.
Figure 1B:
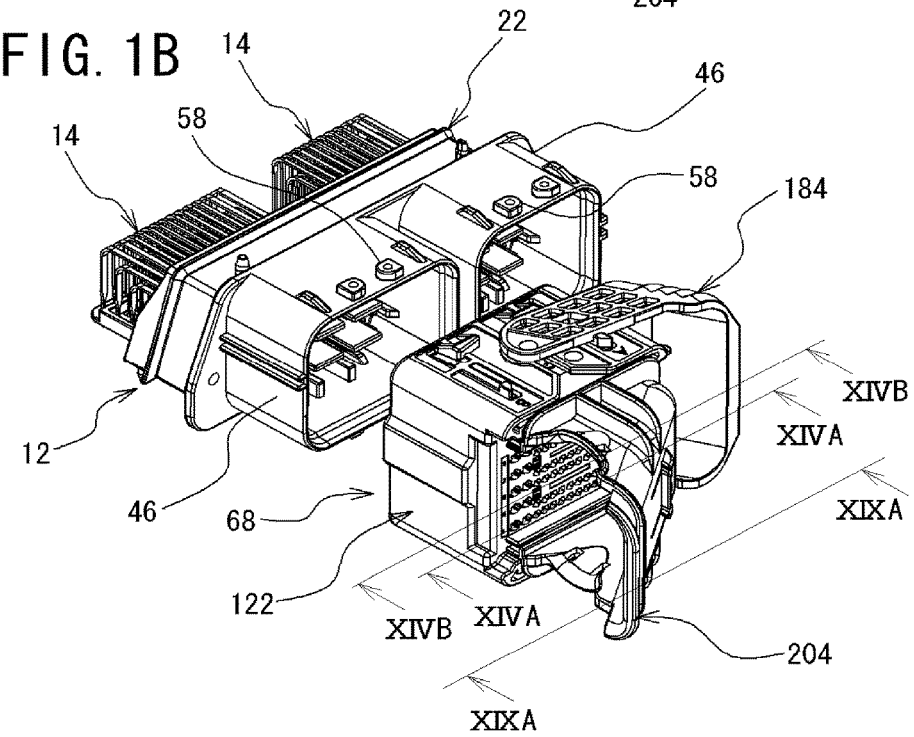
FIG. 1B is a perspective view of the connector before connecting the first and second connector members.
Figure 2A:
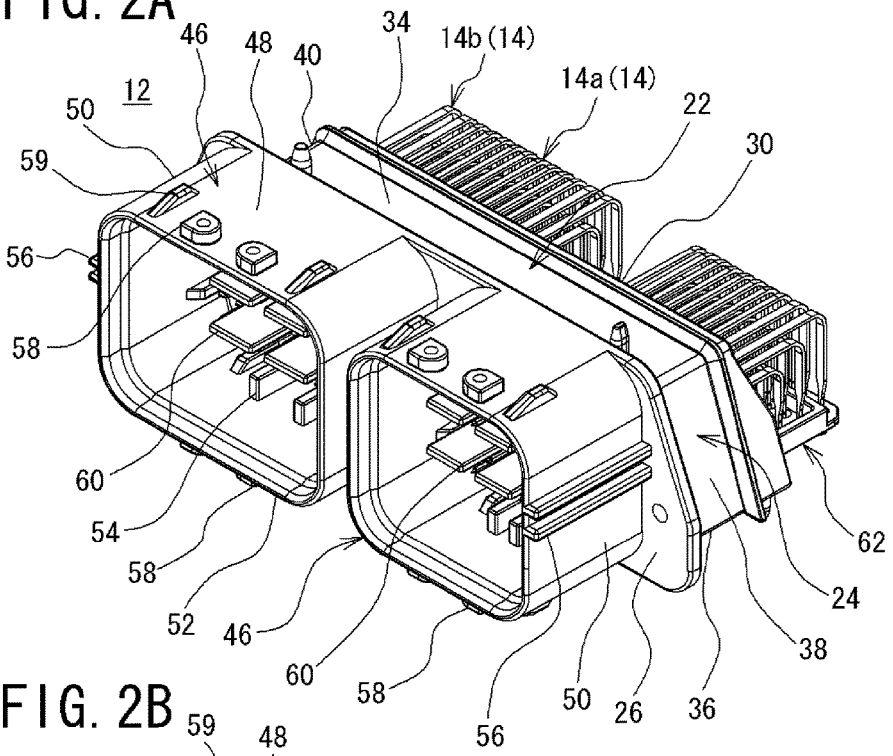
FIG. 2A is a perspective view of the first connector member.
Figure 2B:
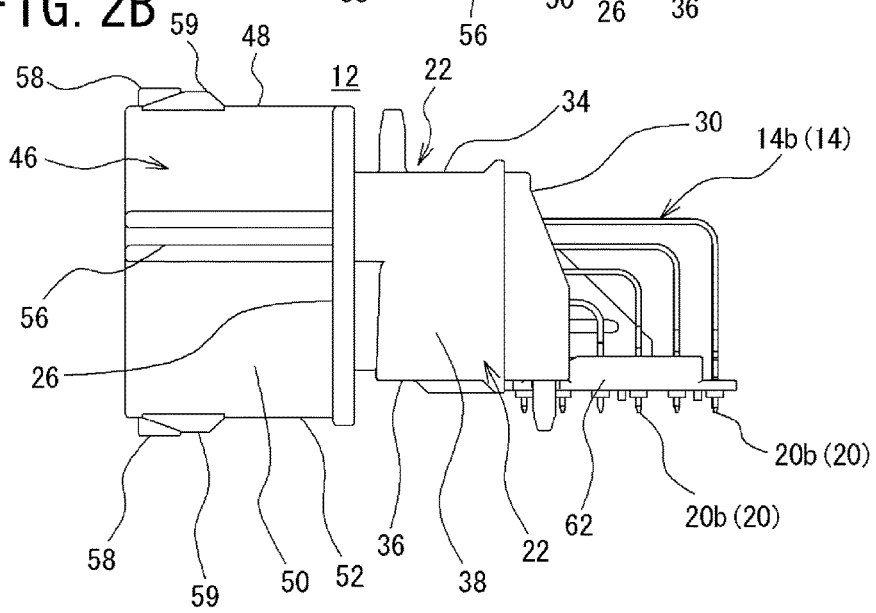
FIG. 2B is a side view of the first connector member seen from one side.
Figure 3A:
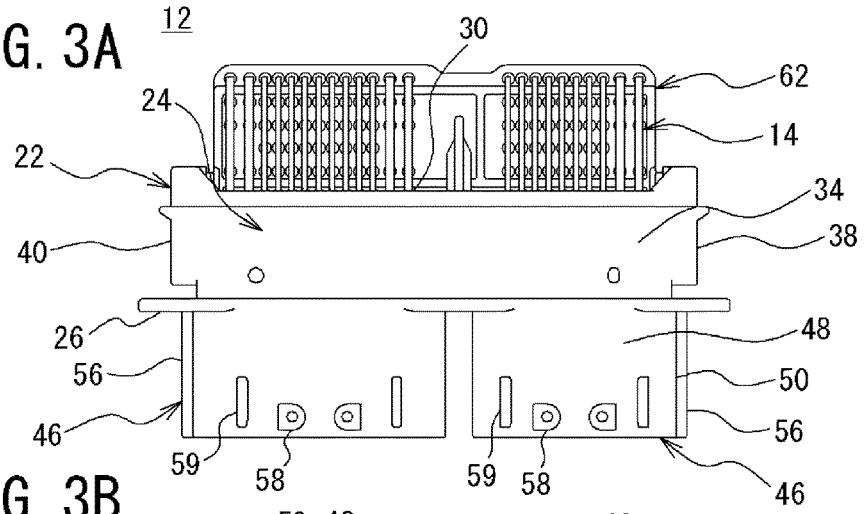
FIG. 3A is a plan view of the first connector member.
Figure 3B:
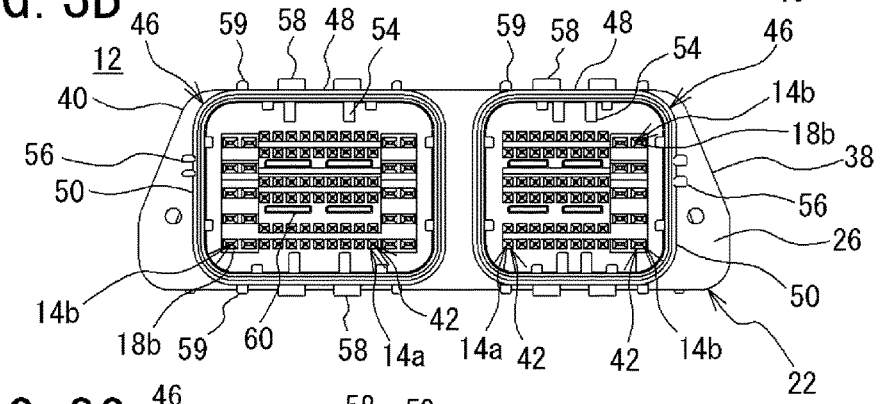
FIG. 3B is a front view of the first connector member.
Figure 3C:
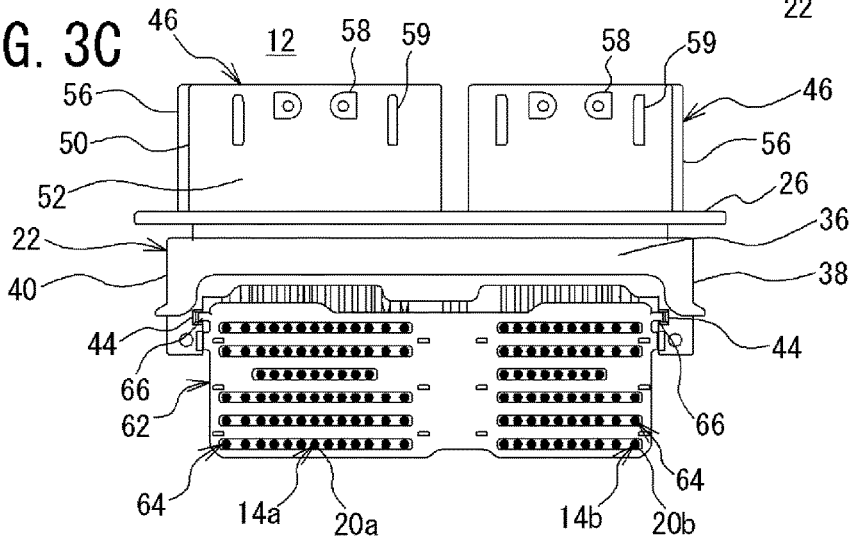
FIG. 3C is a bottom view of the first connector member.

A connector 10 according to an embodiment will now be described with reference to FIGS. 1A to 13B. As illustrated in FIGS. 1A and 1B, the connector 10 of the present embodiment includes a first connector member 12 which is to be mounted on a substrate and the like; and a second connector member 68 which is to be connected to the first connector member 12. The first connector member 12 is configured to be detachable from the second connector member 68. The first and second connector members 12, 68 are provided with a lever member 184 configured to fix or release the connection. Herein, the first connector member 12 is a male connector, and the second connector member 68 is a female connector.

First, the first connector member 12 according to the embodiment will be described with reference to FIGS. 1A to 3C. The first connector member 12 includes a plurality of first contacts 14; a first housing 22 equipped with the plurality of first contacts 14; and a smoothing plate 62 mounted on the first housing 22 and configured to align a side of each first contact 14 which is to be connected to the substrate. Note that the first contacts 14 include first contacts for signals 14*a* and first contacts for power source 14*b* arranged in a plurality of steps and rows. Furthermore, the first housing 22, first contacts 14*a*, and first contacts 14*b* are formed in an integrated manner, for example, by insert formation.

In regard to each of the first contacts for signals 14*a* of the first connector member 12, its metallic rod-like body is partially bent and substantially formed in an L-shape. Each of the first contacts 14*a* includes a first contact body 16*a*, a first contacting part 18*a*, and a connecting part 20*a*. The first contacting part 18*a* is provided to one end of the first contact body 16*a* and configured to be brought into contact with a second contact for signals 70*a* (see FIG. 6A) provided to the second connector member 68. The connecting part 20*a* is provided to the other end of the first contact body 16*a* and configured to be connected to the substrate by solder and the like. Note that the first contacts 14*a* of the first connector member 12 are arranged in the plurality of steps and rows so that they are different in length depending on disposition, but are common in configuration.

The first contacts for power source 14*b* of the first connector member 12 are different from the first contacts for signals 14*a* in size, but substantially similar in configuration. A metallic rod-like body of each first contact for power source 14*b* is partially bent and substantially formed in an L-shape. Each of the first contacts 14*b* includes a first contact body 16*b*, a first contacting part 18*b*, and a connecting part 20*b*. The first contacting part 18*b* is provided to one end of the first contact body 16*b* and configured to be brought into contact with a second contact for power source 70*b* (see FIG. 6B) provided to the second connector member 68. The connecting part 20*b* is provided to the other end of the first contact body 16*b* and configured to be connected to the substrate by solder and the like. Hereinafter, the first contacts for signals 14*a* and first contacts for power source 14*b* provided to the first connector member 12 may be collectively referred to as the first contacts 14.

The first housing 22 includes a first housing body 24 provided with a first contact-containing unit 42 in which the plurality of first contacts 14 is contained in an integrated manner. In one end of the first housing body 24, the first contacting parts 18 of the first contacts 14 and a fitting unit 46 to be connected to the second connector member 68 are disposed. In the other side of the first housing body 24, the connecting parts 20 of the first contacts 14 and the smoothing plate 62 are disposed.

The first housing body 24 of the first housing 22 includes a block body having a predetermined width, surrounded by a first front surface 26 from which the first contacting parts 18 of the first contacts 14 are protruded; a first rear surface 30 from which the connecting parts 20 of the first contacts 14 are protruded; a first top surface 34; a first bottom surface 36; and one and the other first side surfaces 38, 40. In the first contact-containing unit 42, the first contacts for signals 14*a* and first contacts for power source 14*b* slightly larger than those for signals are contained in an integrated manner.

From the first front surface 26 of the first housing body 24, the first contacting parts 18 of the first contacts 14 are protruded, and at least one, herein two tubular fitting units 46 to be connected to the second connector member 68 are stretching in such a manner that these protruded first contacts 14 are surrounded by the fitting units 46. When connecting the first and second connector members 12, 68, these fitting units 46 are inserted into the second connector member 68. Hereinafter, one fitting unit 46 will be described as an example.

The fitting unit 46 is formed in such a manner that a substantially quadrilateral tubular body surrounded by a side 48 closer to the top surface, a side 52 closer to the bottom surface, and both sides 50 closer to the side surfaces is stretching from the first front surface 26 of the first housing body 24 and is integrated with the first housing body 24. Each corner of the fitting unit 46 is formed to have a curved surface.

In regard to the periphery of the tubular body of the fitting unit 46, one side 50 closer to one side surface is formed with an outer guided part 56. When connecting the first and second connector members 12, 68, this outer guided part 56 is guided to a fitting unit-guiding groove 168 (see FIG. 8) formed in a hood member 122 of the second connector member 68. Since the outer guided part 56 is formed in one side 50 closer to one side surface, reverse connection of the second connector member 68 can be avoided.

The sides 48, 52 of the fitting unit 46 closer to the top and bottom surfaces are formed with a plurality of protrusive protruded part-pressing protrusions 59. Each of these protruded part-pressing protrusions 59 is inclined in a direction of insertion or removal. When mounting the hood member 122, the protruded part-pressing protrusions 59 are guided and presses protruded parts 164 (see FIGS. 8A and 9B) formed in the hood member 122 (to be mentioned). Furthermore, the protruded part-pressing protrusions 59 perform as parts to move lever member-locking protrusions 158 in which the lever member 184 provided outside the hood member 122 is locked and to release the lock of the lever member 184.

Each of the sides 48, 52 of the fitting unit 46 closer to the top and bottom surfaces is formed with at least one, herein two protrusions 58. These protrusions 58 are to be combined with the lever member 184 provided to the second connector member 68 (to be mentioned) so as to fix or release the connection of the connector 10.

In regard to inner peripheral parts of the sides 48, 52 of the fitting unit 46 closer to the top and bottom surfaces and inner peripheral parts of the both sides 50 of the fitting unit 46 closer to the side surfaces, those parts are formed with a plurality of protrusive inner guided parts 54. When connecting the first and second connector members 12, 68, these inner guided parts 54 are guided by guiding grooves 108 formed in a second housing 84 of the second connector member 68.

A plurality of guided plates 60 protruded from the first front surface 26 of the first housing body 24 is formed inside the fitting unit 46. These guided plates 60 are to be inserted into guiding holes 90 formed in the second housing 84 of the second connector member 68.

From the first rear surface 30 of the first housing body 24, the connecting parts 20 of the first contacts 14 are protruded. Furthermore, a part of the first rear surface 30 of the first housing body 24 closer to the first bottom surface 36 is formed with smoothing plate-mounted parts 44 configured to be mounted with the smoothing plate 62.

The smoothing plate 62 includes a plate-like body formed with a plurality of through-holes 64 to be penetrated by the connecting parts 20 of the first contacts 14. The smoothing plate 62 is configured to align the connecting parts 20 and to smooth the connection to the substrate and the like. A side of this smoothing plate 62 which is to be mounted on the first housing 22 is formed with mounted parts 66.

In the first connector member 12 herein, the first housing 22 and the first contacts 14 have been illustrated that they are formed in an integrated manner by the insert formation, but they should not be restricted thereto. A first housing and first contacts may be formed separately and then put together.

Next, the second connector member 68 will be described with reference to FIGS. 1A and 1B and FIGS. 4A to 13B. In the connector 10 herein, two second connector members 68 are provided to the first connector member 12. It should be noted that these second connector members 68 are common in structure except that a part of the structure is formed symmetrically. Hereinafter, one second connector member 68 will be described as an example.

Figure 4A:
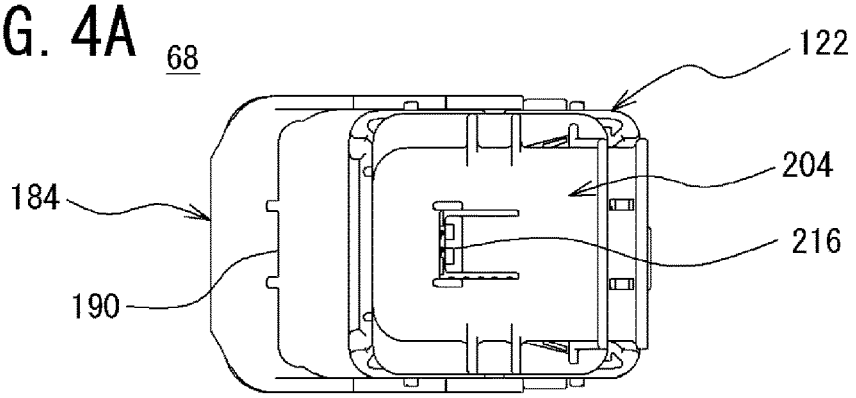
FIG. 4A is a rear view of the second connector member.
Figure 4B:
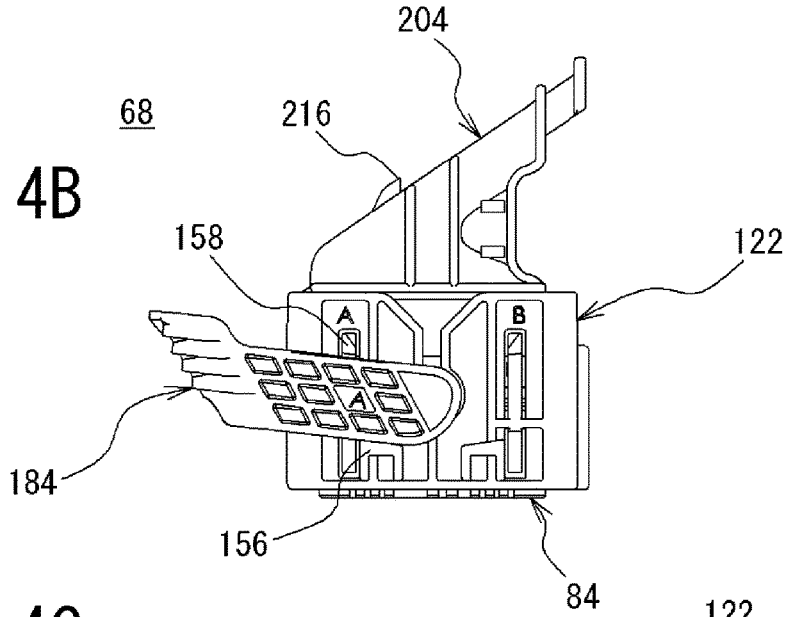
FIG. 4B is a plan view of the second connector member.
Figure 4C:
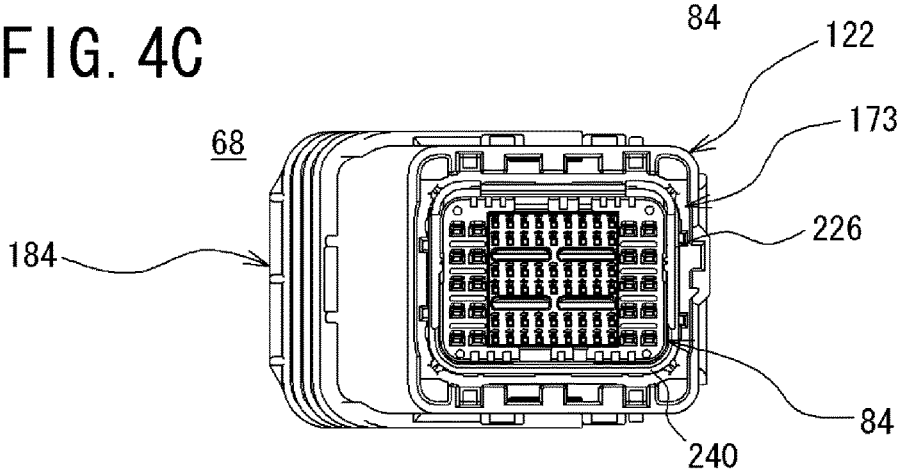
FIG. 4C is a front view of the second connector member.
Figure 5:
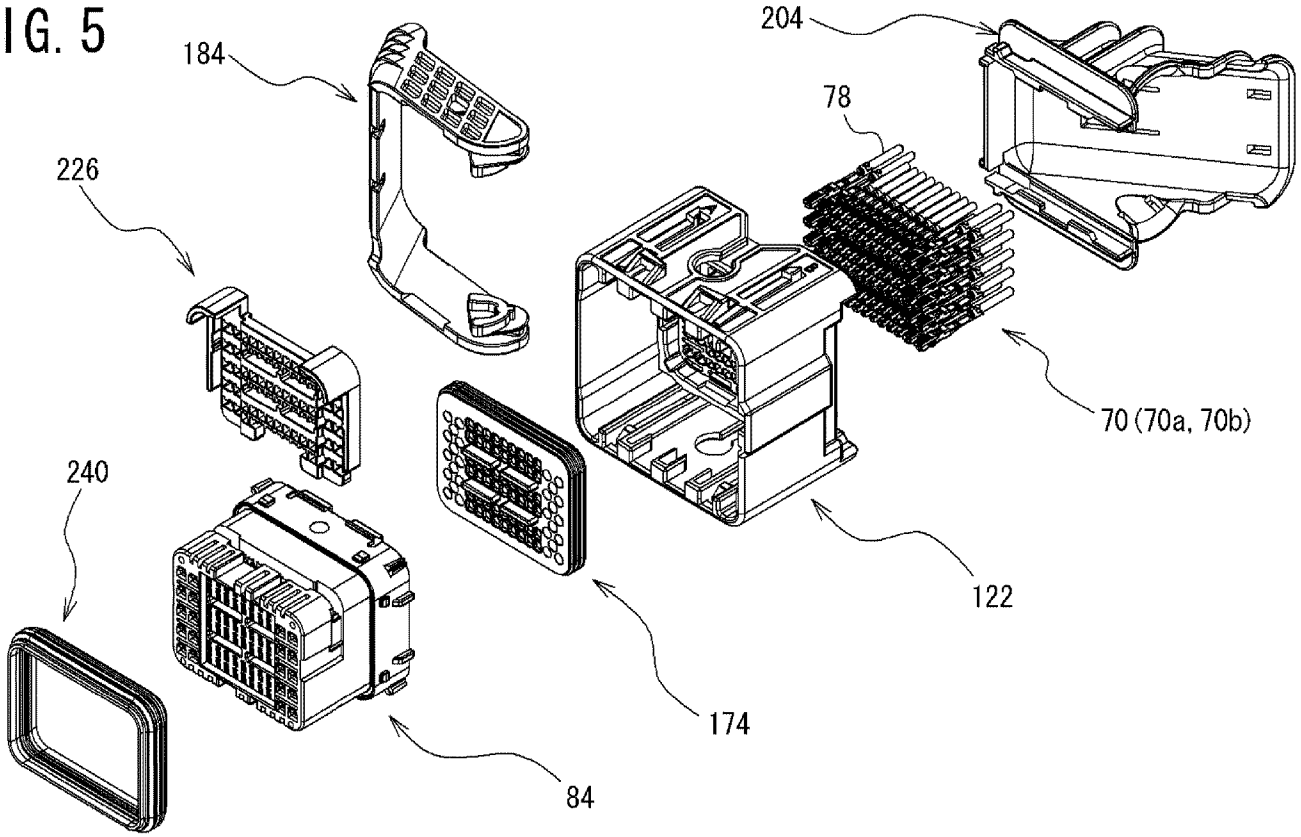
FIG. 5 is a perspective view illustrating the second connector member taken apart.
Figure 6A:
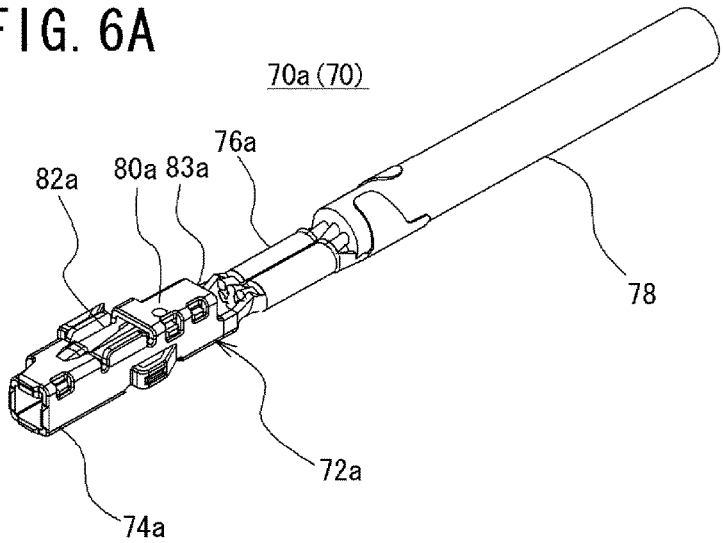
FIG. 6A is a perspective view of a second contact for signals.
Figure 6B:
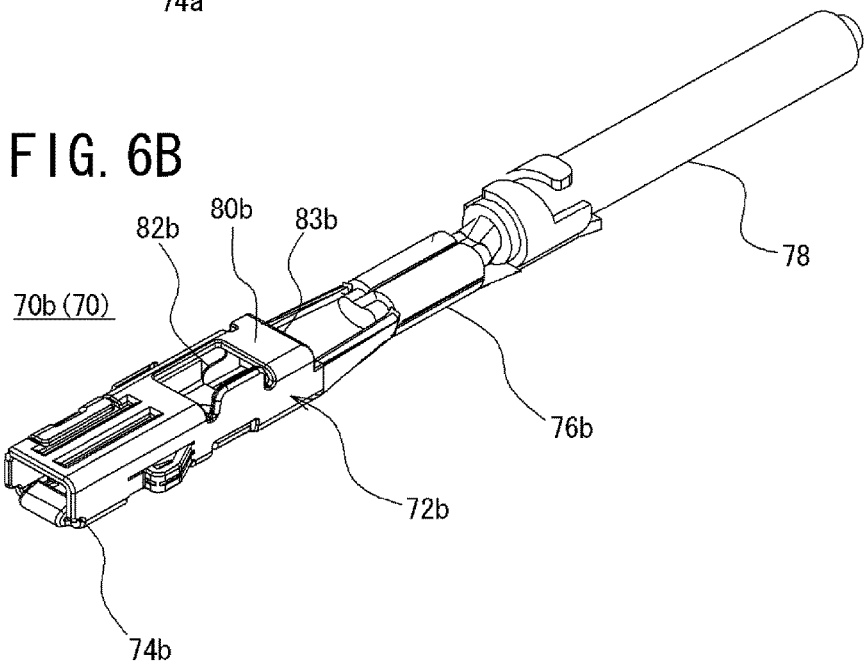
FIG. 6B is a perspective view of a second contact for power source.

As illustrated in FIGS. 4A to 5, the second connector member 68 includes: a plurality of second contacts 70 to which wires 78 are connected; the second housing 84 formed with a second contact-containing unit 120 configured to contain the plurality of second contacts 70; a retainer 226 configured to position and fix the second contacts 70 contained in the second housing 84; a seal member 240 provided to the periphery of the second housing 84 in an annular manner; the hood member 122 provided so as to cover the second housing 84; a wire seal 174 performing as an elastic member, provided between an inside of the hood member 122 and the second housing 84; a cover member 204 provided to a side of the hood member 122 opposite to a side to be connected to the first connector member 12; and the lever member 184 rotatably provided to the hood member 122. In regard to the second contacts 70, the second contacts for signals 70*a* as in FIG. 6A and the second contacts for power source 70*b* as in FIG. 6B are arranged in a plurality of steps and rows.

First, the second contacts for signals 70*a* will be described as follows. As illustrated in FIG. 6A, each second contact for signals 70*a* includes a tubular second contact body 72*a*; a second contacted part 74*a*, and a wire-equipped part 76*a*. The second contacted part 74*a* is provided to one end of the second contact body 72*a* and configured to be brought into contact with the inserted first contacting part 18*a* of the first contact for signals 14*a*. The wire-equipped part 76*a* is provided to the other end of the second contact body 72*a* and configured to be equipped with the wire 78. An upper side 80*a* of the second contact body 72*a* is formed with an inserted part 82*a* into which a claw-shaped lance (not illustrated) is to be inserted. The claw-shaped lance is provided inside the second contact-containing unit 120 of the second housing 84 (to be mentioned). Furthermore, a part of the second contact body 72*a* closer to the wire-equipped part 76*a* is formed with a fixed part 83*a* configured to be positioned and fixed when engaged with a fixing protrusion 232 of the retainer 226.

Next, the second contacts for power source 70*b* will be described as follows. As illustrated in FIG. 6B, the second contacts for power source 70*b* are substantially common with the second contacts for signals 70*a* in structure. Each second contact for power source 70*b* includes a tubular second contact body 72*b*, a second contacted part 74*b*, and a wire-equipped part 76*b*. The second contacted part 74*b* is provided to one end of the second contact body 72*b* and configured to be brought into contact with the inserted first contacting part 18*b* of the first contact for power source 14*b*. The wire-equipped part 76*b* is provided to the other end of the second contact body 72*b* and configured to be equipped with the wire 78. An upper side 80*b* of the second contact body 72*b* is formed with an inserted part 82*b* into which the claw-shaped lance (not illustrated) is to be inserted. The claw-shaped lance is provided inside the second contact-containing unit 120 of the second housing 84 (to be mentioned). Furthermore, a part of the second contact body 72*b* closer to the wire-equipped part 76*b* is formed with a fixed part 83*b* configured to be positioned and fixed when engaged with the fixing protrusion 232 of the retainer 226. Hereinafter, the second contacts for signals 70*a* and second contacts for power source 70*b* provided to the second connector member 68 may be collectively referred to as the second contacts 70.

Figure 7A:
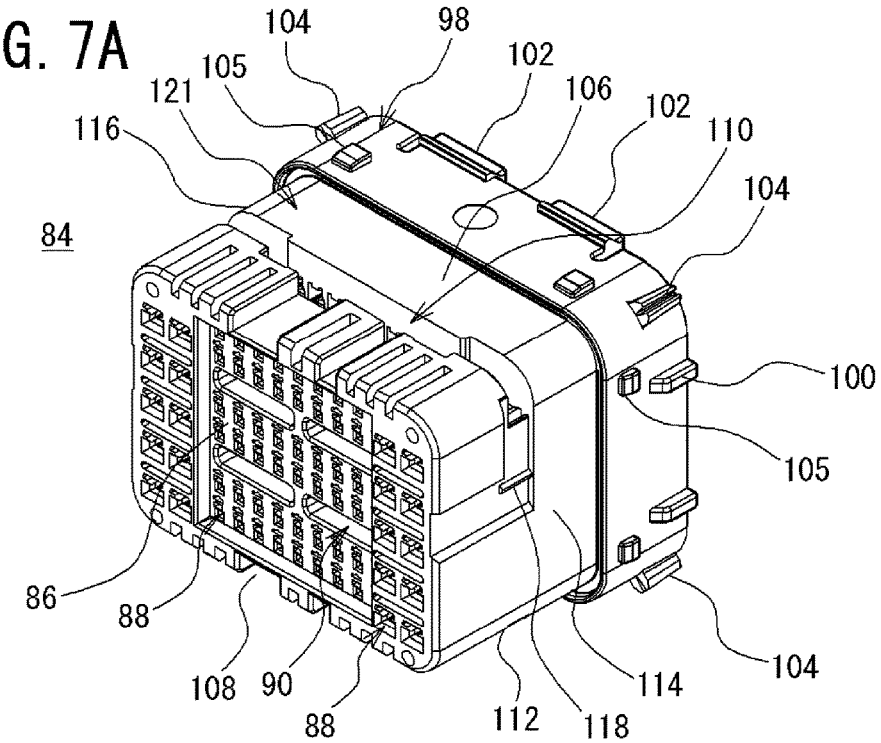
FIG. 7A is a perspective view of a second housing seen from one side.
Figure 7B:
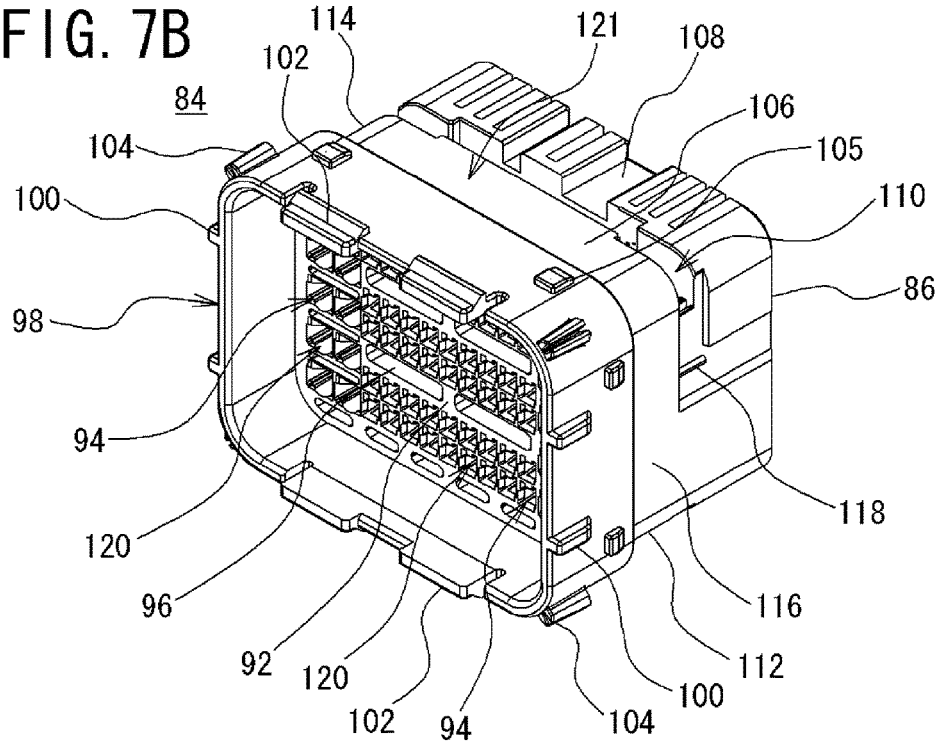
FIG. 7B is a perspective view of the second housing seen from the other side.
Figure 8A:
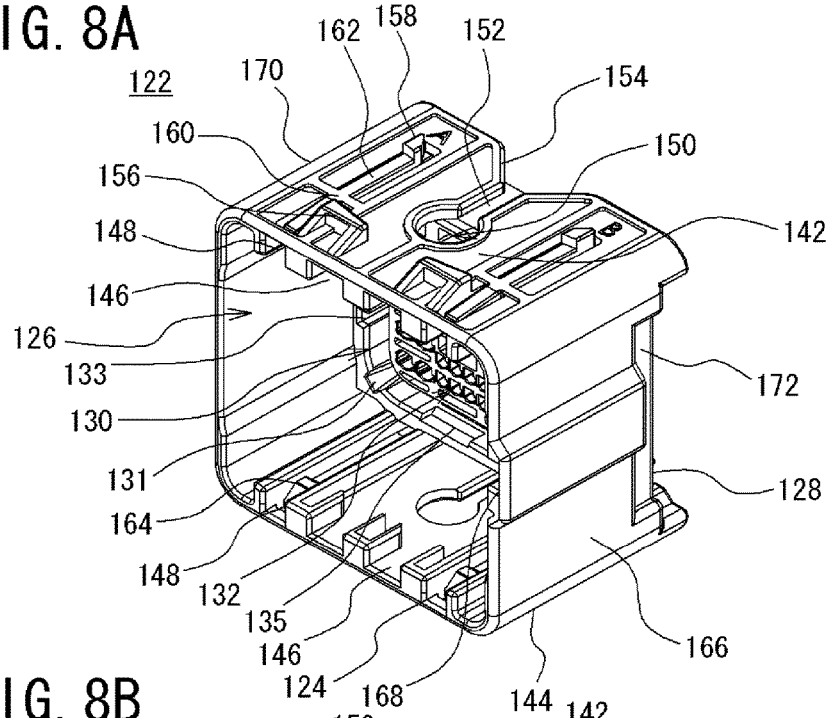
FIG. 8A is a perspective view of a hood member seen from one side.
Figure 8B:
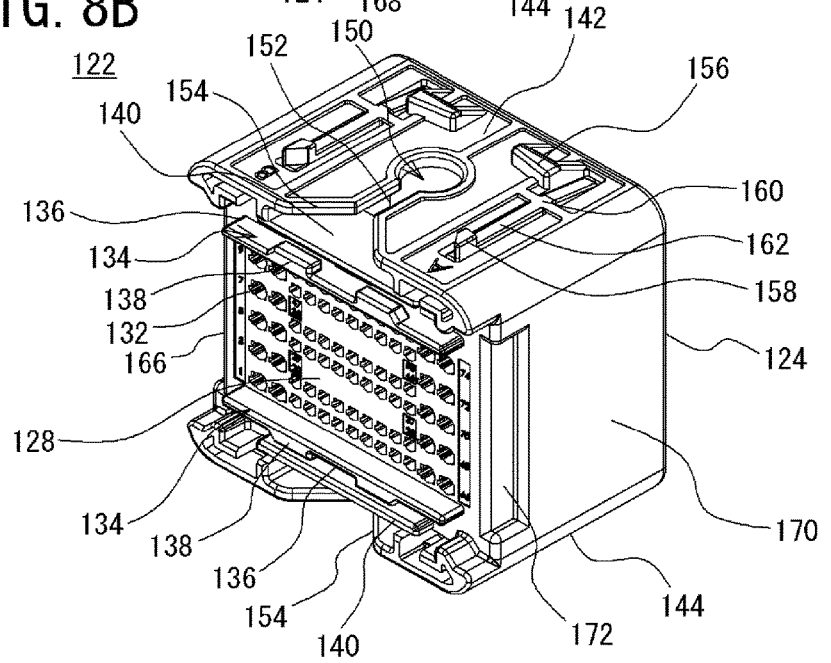
FIG. 8B is a perspective view of the hood member seen from the other side.
Figure 9A:
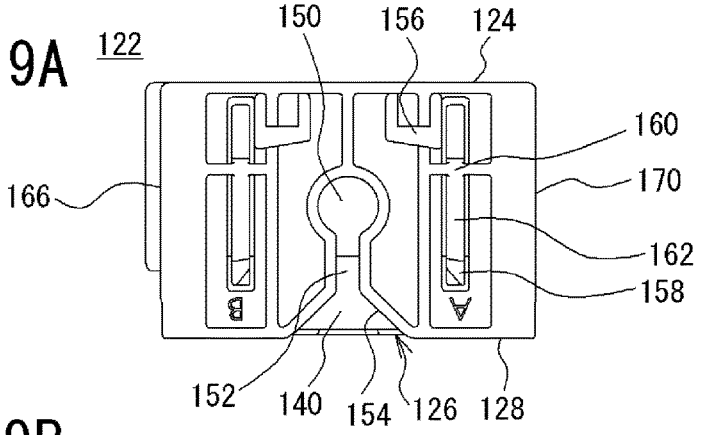
FIG. 9A is a plan view of the hood member.
Figure 9B:
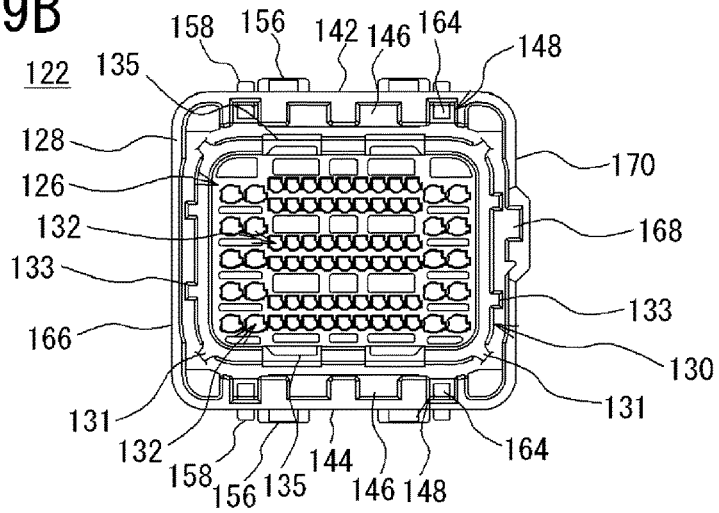
FIG. 9B is a front view of the hood member.
Figure 9C:
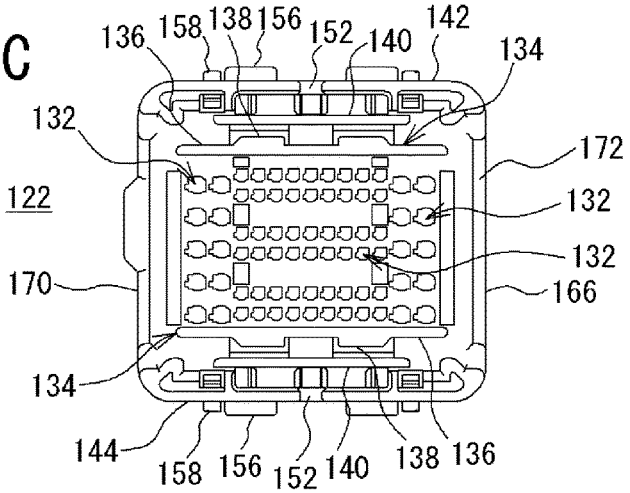
FIG. 9C is a rear view of the hood member.
Figure 10A:
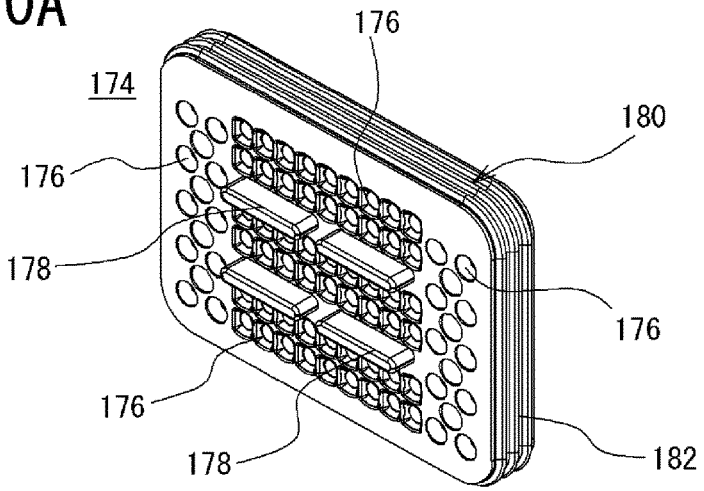
FIG. 10A is a perspective view of a wire seal.
Figure 10B:
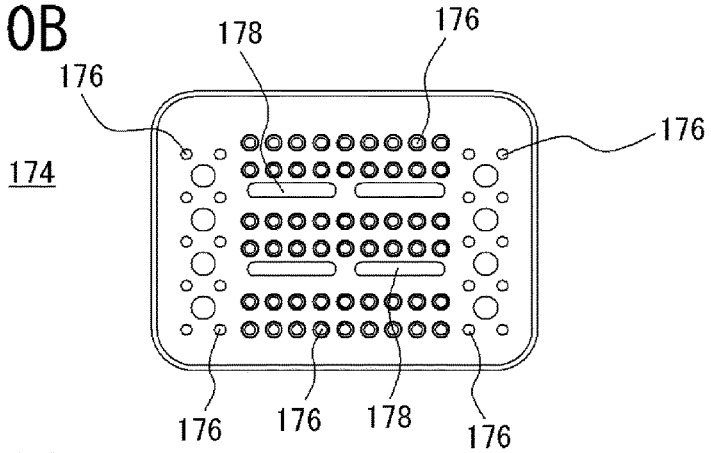
FIG. 10B is a front view of the wire seal.
Figure 10C:
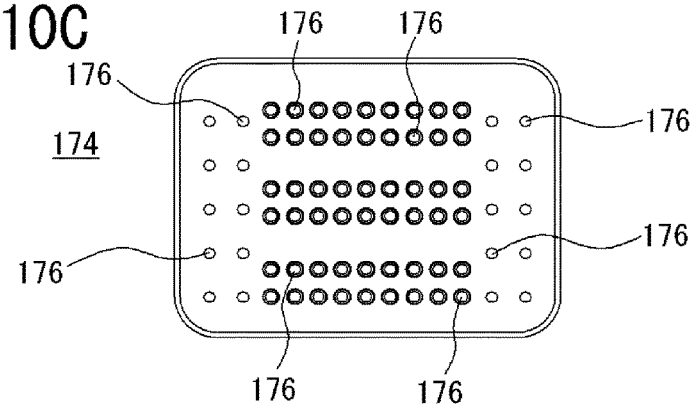
FIG. 10C is a bottom view of the wire seal.

Next, the second housing 84 will be described with reference to FIGS. 7A and 7B. The second housing 84 is formed of a resin material and includes a block body having a second front surface 86, a second rear surface 92, a second top surface 106, a second bottom surface 112, and one and the other second side surfaces 114, 116. The second front surface 86 is formed with a plurality of first contact-inserted parts 88 into which the first contacts 14 of the first connector member 12 to be connected to the second contacts 70 contained inside the second housing 84 are to be inserted. The second rear surface 92 is formed with a plurality of second inserted holes 94 into which the second contacts 70 are to be inserted. The second top surface 106 is formed with a retainer-equipped groove 110 configured to be equipped with the retainer 226. The second bottom surface 112 is disposed in an opposite side of the second top surface 106. Inside the second housing 84, the second contact-containing unit 120 configured to contain the plurality of second contacts 70 is formed in such a manner that the second inserted holes 94 and the first contact-inserted parts 88 formed in the second front surface 86 are linked to each other.

In regard to the second front surface 86 of the second housing 84, the plurality of first contact-inserted parts 88 into which the first contacting parts 18 of the first contacts 14 are to be inserted and the plurality of guiding holes 90 into which the guided plates 60 formed in the first housing 22 are to be inserted are formed throughout the inside of the second housing 84. Note that each first contact-inserted part 88 is communicated with the second contact-containing unit 120.

The second rear surface 92 of the second housing 84 is formed with the second inserted holes 94 into which the second contacts 70 are to be inserted and which are communicated with the second contact-containing unit 120. The second rear surface 92 is also formed with wire seal-inserted grooves 96 configured to be fitted with inserting protrusions 178 (see FIGS. 10A and 10B) formed in the wire seal 174 which is to be disposed in the second rear surface 92. The second inserted holes 94 are formed in such a manner that the second contacts for signals 70*a* and the second contacts for power source 70*b* slightly larger than those for signals can be inserted.

In the periphery of the second rear surface 92, that is, in the second top surface 106, second bottom surface 112, and one and the other second side surfaces 114, 116, a tubular enclosure 98 is formed, stretching from the second rear surface 92. This enclosure 98 is a part where the wire seal 174 is to be contained and which is to be mounted on the hood member 122. Each side of the enclosure 98 closer to the second top surface 106, second bottom surface 112, and one and the other second side surfaces 114, 116 is formed with hood member-guiding parts 100. When mounting the second housing 84 on a second housing-mounted part 130 (see FIG. 8A) of the hood member 122, these hood member-guiding parts 100 guide the insertion of the second housing 84. In each side of the enclosure 98 closer to the second top surface 106, and second bottom surface 112, hood member-mounted parts 102 are formed. The hood member-mounted parts 102 are to be mounted on the second housing-mounted part 130 of the hood member 122.

In the second top surface 106 of the second housing 84, the retainer-equipped groove 110 configured to be equipped with the retainer 226 is formed from one second side surface 114 to the other second side surface 116. Furthermore, a part of the second top surface 106 closer to the second front surface 86 is formed with the guiding grooves 108 configured to guide the inner guided parts 54 of the first housing 22.

The second bottom surface 112 of the second housing 84 is also formed with the guiding grooves 108 configured to guide the inner guided parts 54 of the first housing 22.

Each of one and the other second side surfaces 114, 116 is formed with a retainer-locking protrusion 118 configured to lock the retainer 226 which is to be equipped from the second top surface 106.

Each peripheral corner of the enclosure 98 of the second housing 84 is formed with a protrusive vibration-resistant protrusion 104. Each vibration-resistant protrusion 104 has two rows of plate-like protrusions. As approaching the second rear surface 92, a width between the two rows of the plate-like protrusions is separated. In other words, each vibration-resistant protrusion 104 is spreading like an unfolded fan. In assembling the second connector member 68, these vibration-resistant protrusions 104 are to be fitted in vibration-resistant protrusion-inserted grooves 131 formed in the hood member 122 (to be mentioned).

Next, the hood member 122 will be described with reference to FIGS. 8A to 9C. The hood member 122 is formed of a resin material and includes a box-like body having a front face 124, a rear face 128, a top face 142, a bottom face 144, and one and the other side faces 166, 170. The second housing 84 is to be inserted into the front face 124. Furthermore, the front face 124 is formed with an opening 126 configured to be fitted with the fitting unit 46 of the first housing 22 of the inserted first connector member 12. The rear face 128 is formed with wire-penetrated holes 132 which are to be penetrated by a plurality of wires 78. Each of the top and bottom faces 142, 166 is formed with a bearing 150 in which the lever member 184 is to be rotatably disposed.

The second housing-mounted part 130 configured to be mounted with the second housing 84 is formed inside the hood member 122, closer to the rear face 128. The second housing-mounted part 130 is formed with grooves 133. The grooves 133 are to be guided by the hood member-guiding parts 100 formed in the periphery of the enclosure 98 of the second housing 84. In mounting the second housing 84, the grooves 133 are guided by the hood member-guiding parts 100. Furthermore, the second housing-mounted part 130 is formed with engaged parts 135 disposed in the periphery of the enclosure 98 of the second housing 84. The engaged parts 135 are to be mounted with the hood member-mounted parts 102. In mounting the second housing 84, the engaged parts 135 are engaged with the hood member-mounted parts 102. Still further, each corner of the second housing-mounted part 130 is formed with a wedged vibration-resistant protrusion-inserted groove 131 configured to be fitted with each vibration-resistant protrusion 104 formed in the periphery of the enclosure 98 of the second housing 84. In mounting the second housing 84 on the hood member 122, once the vibration-resistant protrusions 104 spreading like an unfolded fan, formed in the enclosure 98 of the second housing 84 are fitted with the vibration-resistant protrusion-inserted grooves 131, the vibration-resistant protrusions 104 are deformed in such a manner that the width thereof becomes narrow. Accordingly, the vibration-resistant protrusions 104 and vibration-resistant protrusion-inserted grooves 131 are engaged with no space so that the second housing 84 and hood member 122 are fixed. Therefore, it is possible to achieve high durability with respect to vibration and the like.

In a case of mounting the second housing 84 on the hood member 122, note that a space 173 is formed between the periphery of the second housing 84 and the inside of the hood member 122. This space 173 is where the fitting unit 46 of the first connector member 12 is to be fitted when connecting the first and second connector members 12, 68 (see FIG. 4C).

Furthermore, passage grooves 146 through which the protrusions 58 formed in the first housing 22 are to pass are formed inside the hood member 122 closer to the top and bottom faces 142, 144. Still further, guiding rail parts 148 sandwiched by both side walls, configured to guide the protruded part-pressing protrusions 59 formed in the first housing 22 are formed outside the passage grooves 146, that is, in parts closer to one and the other side faces 166, 170. Those parts of the guiding rail parts 148 closer to the opening 126 are provided with the protruded parts 164 configured to be pressed by the protruded part-pressing protrusions 59.

In substantially central parts of inner parts of the top and bottom faces 142, 144 of the hood member 122, bearings 150 penetrating the top and bottom faces 142, 144 are formed. In these bearings 150, shafts 194 of the lever member 184 (to be mentioned) are to be rotatably disposed.

Note that claw-shaped parts 196 of the lever member 184 are to be disposed inside the top and bottom faces 142, 144 of the hood member 122.

Inside the hood member 122, a side closer to one side face 166 is formed with the fitting unit-guiding groove 168 configured to guide the outer guided part 56 formed in the first housing 22.

The front face 124 of the hood member 122 is formed with the opening 126 into which the second housing 84 is to be inserted when assembling the second connector member 68. This opening 126 also performs as a part to be fitted with the fitting unit 46 of the first housing 22 when connected to the first connector member 12. Note that those parts of the front face 124 closer to the top face 142, bottom face 144, and one side face 166 are formed with grooves linked to the passage grooves 146, the guiding rail parts 148, and the fitting unit-guiding groove 168 formed inside the hood member 122.

The rear face 128 of the hood member 122 is formed with a plurality of wire-penetrated holes 132 configured to be penetrated by the wires 78. The wire-penetrated holes 132 penetrate the rear face 128 from the front face 124. There are two types of wire-penetrated holes 132, that is, one for signals; and one for power source.

In the rear face 128 of the hood member 122, each part closer to the top and bottom faces 142, 144 is formed with a cover member-mounted part 134 which is to be mounted with the cover member 204 (to be mentioned). These cover member-mounted parts 134 are formed in such a manner that plate-like ribs 136 are protruded from the rear face 128 of the hood member 122 and that a pair of protrusive projected parts 138 is formed in those sides of the ribs 136 closer to the top and bottom faces 142, 144.

The hood member 122 is provided with stages 172 disposed from the rear face 128 to one side face 166 and from the rear face 128 to the other side face 170. Each stage 172 is partially chipped and formed in a step-like shape.

The top and bottom faces 142, 144 of the hood member 122 are formed with the bearings 150 penetrating both faces till reaching inside the hood member 122. From the bearings 150 formed in the top and bottom faces 142, 144 to the rear face 128, penetrated grooves 152 are formed which are to be penetrated by the shafts 194 of the lever member 184 when assembling the lever member 184. Note that a part of each penetrated groove 152 closer to the rear face 128 is formed with an inclined part 154 cut in an inclined manner. These inclined parts 154 smooth the penetration of the shafts 194 of the lever member 184.

Between the cover member-mounted part 134 in the rear face 128 and the top face 142 of the hood member 122, a plate-like member 140 is formed in a position substantially adjacent to the bearing 150. This plate-like member 140 is a part along which the cover member 204 is moved when the cover member 204 is mounted on the hood member 122. Furthermore, the plate-like member 140 disposed inside the hood member 122 is a part configured to be brought into contact with the fitting unit 46 of the first connector member 12 when connecting the first and second connector members 12, 68 (see FIGS. 16A, and 17A).

The top and bottom faces 142, 144 of the hood member 122 are provided with lever member-restraining parts 156 protruded from those parts closer to the front face 124; and lever member-locking protrusions 158 formed in those parts closer to the rear face 128. These lever member-restraining parts 156 and lever member-locking protrusions 158 are disposed in pairs in the top and bottom faces 142, 144 so as to restrain the rotation of the lever member 184 when assembling the second connector member 68.

Note that the lever member-locking protrusions 158 are reciprocatingly movable. In other words, those parts of the top and bottom faces 142, 144 closer to one and the other side faces 166, 170 are provided with rod-like bodies 162 each of which is reciprocatingly movable around a supporting point 160. The protruded parts 164 formed inside the hood member 122 are formed in those parts of these rod-like bodies 162 closer to the front face 124, and the lever member-locking protrusions 158 are formed in those parts of these rod-like bodies 162 closer to the rear face 128. When connecting to the first connector member 12, once the protruded part-pressing protrusions 59 formed in the fitting unit 46 of the first housing 22 press the protruded parts 164, the rod-like bodies 162 are configured to rotate around each supporting point 160, and the lever member-locking protrusions 158 are configured to move in a direction opposite to the pressing direction of the protruded parts 164 so as to release the lock of the lever member 184.

Next, the wire seal 174 will be described with reference to FIGS. 5, and 10A to 10C. The wire seal 174 includes a plate-like body having a predetermined thickness and formed with a plurality of wire-penetrated parts 176 which is to be penetrated by the plurality of wires 78. Furthermore, the wire seal 174 is formed of an elastic member having elasticity such as rubber.

In a side to be connected to the second housing 84, the wire seal 174 is formed with a plurality of inserting protrusions 178 which is to be inserted into the wire seal-inserted grooves 96 formed in the second housing 84.

A periphery 180 of the wire seal 174 is formed with annular recesses and projections 182.

The wire seal 174 is configured to be mounted on the hood member 122 together with the second housing 84 with being mounted on an inner part of the enclosure 98 closer to the second rear surface 92 of the second housing 84. Therefore, the wire seal 174 is configured to be sandwiched between the inside of the hood member 122 and the second housing 84.

Figure 11A:
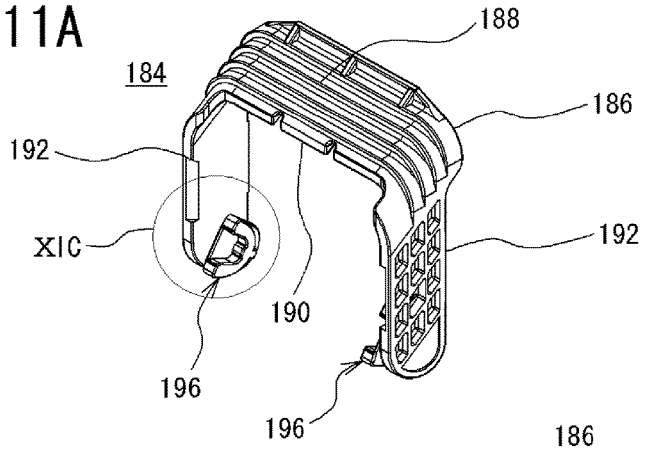
FIG. 11A is a perspective view of a lever member.
Figure 11B:
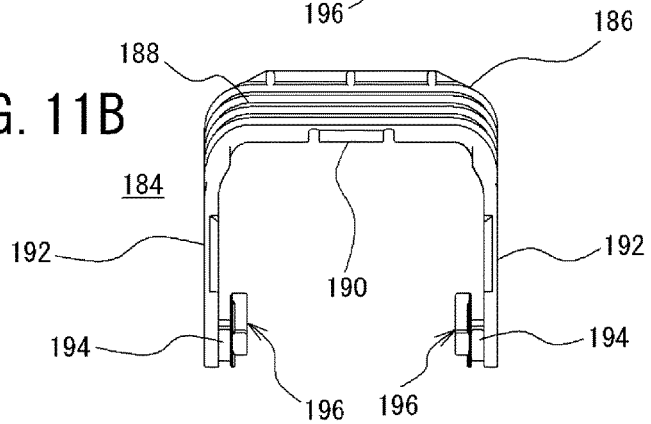
FIG. 11B is a front view of the lever member.
Figure 11C:
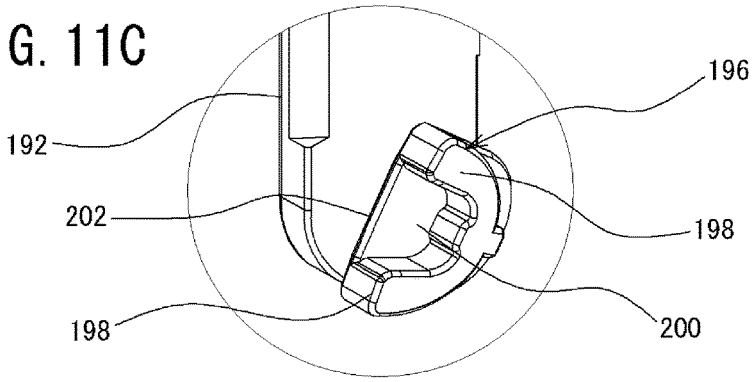
FIG. 11C is an enlarged view of a part XIC illustrated in FIG. 11A.

Next, the lever member 184 will be described with reference to FIGS. 11A to 11C. The lever member 184 is formed of a resin material, including: an operation part 186 having a predetermined length; a pair of arms 192 opposing each other, stretching from both sides of the operation part 186; the shafts 194 each of which is disposed in an inner end part of each arm 192, protruded in a direction in which both shafts 194 face each other; and the claw-shaped parts 196 each of which is provided to an end of each shaft 194.

The operation part 186 is used when a user operates the lever member 184. For example, in a surface of the operation part 186 opposing the side from which the arms 192 are stretching, a plurality of recessed and projected grooves 188 is formed to avoid slipping.

Furthermore, a lock unit 190 is formed in a side end of the surface on which the recessed and projected grooves 188 of the operation part 186 are formed. When connecting the first and second connector members 12, 68, this lock unit 190 is locked and fixed with a protrusive lock 216 (see FIGS. 12B and 12C) formed in the cover member 204 (to be mention).

The arms 192 are plates having a predetermined length. When the lever member 184 rotates, the arms 192 move along the top and bottom surfaces 142, 144 of the hood member 122.

The shafts 194 are configured to link the arms 192 and claw-shaped parts 196. Each shaft 194 has a length long enough to pass through each bearing 150 formed in the top and bottom faces 142, 144 of the hood member 122. In other words, the length of each shaft 194 is substantially equal to the thickness of top face 142 and that of the bottom face 144 of the hood member 122. Note that the shafts 194 herein are formed in a plate-like shape in such a manner that the shafts 194 can penetrate the penetrated grooves 152 formed in the hood member 122.

The claw-shaped parts 196 are configured to hook the protrusions 58 formed in the fitting unit 46 of the first housing 22 of the first connector member 12 and are moved, drawing the protrusions 58, in accordance with the rotation of the lever member 184. Herein, the claw-shaped parts 196 are formed with a pair of two-pronged claw members 198 substantially having a U-shape. Each claw-shaped part 196 is provided with a drawing part 200 formed between the claw members 198, performing as a space to draw the protrusion 58.

A side of each claw-shaped part 196 closer to each arm 192 is formed with a wall 202 configured to prevent the claw-shaped part 196 from being hooked by other members in accordance with the rotation of the lever member 184.

Figure 12A:
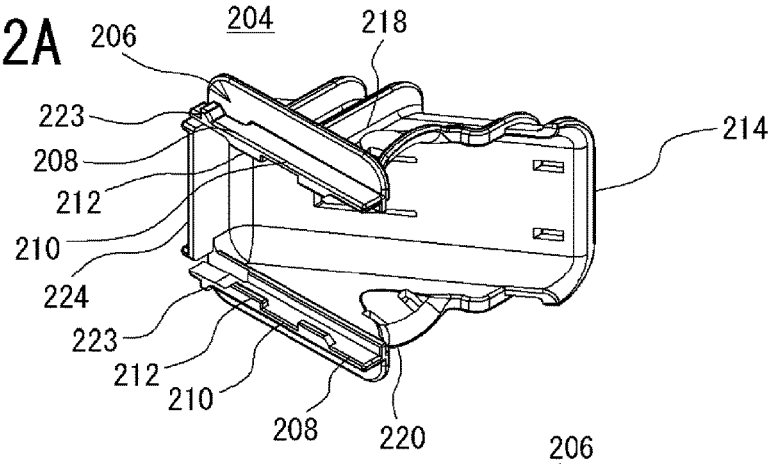
FIG. 12A is a perspective view of a cover member.
Figure 12B:
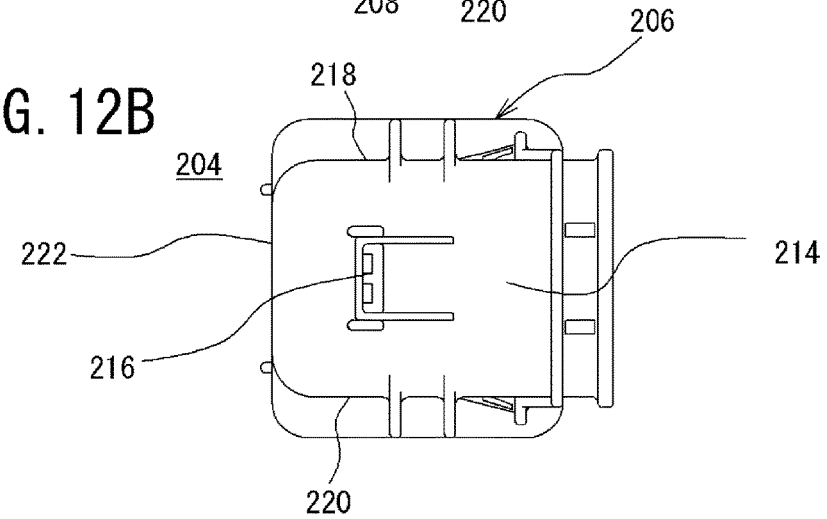
FIG. 12B is a rear view of the cover member.
Figure 12C:
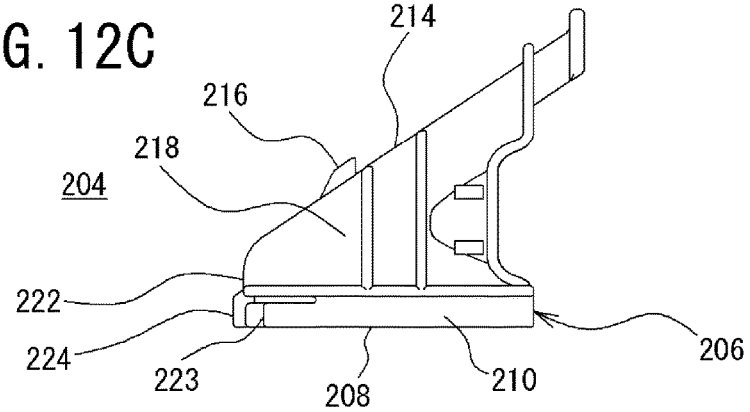
FIG. 12C is a plan view of the cover member.

Next, the cover member 204 will be described with reference to FIGS. 12A to 12C. The cover member 204 is to be mounted on the rear face 128 of the hood member 122 and is configured to form a passage for guiding the plurality of penetrated wires 78.

A mounting surface 206 of the cover member 204 which is to be mounted on the hood member 122 is opened. Furthermore, the cover member 204 is formed in such a manner that the passage for guiding the wires 78 introduced from the mounting surface 206 is formed toward a substantially perpendicular direction with respect to the fitting direction of the first and second connector members 12, 68. A guiding wall surface 214 disposed in an opposite side of the mounting surface 206 is inclined. A cover top surface 218, a cover bottom surface 220, and a cover side surface 222 surround the cover member 204 so as to link the mounting surface 206 and the guiding wall surface 214. An opposite side of the cover side surface 222 is opened so that the wires 78 can be put out.

In regard to the mounting surface 206 of the cover member 204, each side closer to the cover top and cover bottom surfaces 218, 220 is formed with a mounted part 208 which is to be mounted on the cover member-mounted part 134 formed in the rear face 128 of the hood member 122. Each mounted part 208 is configured to include a plate-like slide 210 stretching from the mounting surface 206 toward the hood member 122; and projected parts 212 formed in such a manner that this slide 210 is partially protruded in a direction perpendicular to the slide 210.

Apart of each slide 210 closer to the cover side surface 222 is formed with a locking protrusive part 223 configured to fix the cover member-mounted part 134.

The cover side surface 222 of the cover member 204 is formed with a side wall 224 stretching toward the hood member 122.

Furthermore, the protrusive lock 216 is formed outside the guiding wall surface 214 of the cover member 204. The protrusive lock 216 is configured to fix the lock unit 190 of the lever member 184.

Note that the cover member 204 is to be mounted on the hood member 122 in such a manner that the mounting surface 206 of the cover member 204 is slid from the other side face 170 of the hood member 122 and then mounted on the cover member-mounted part 134 of the hood member 122. On this occasion, the ribs 136 of the cover member-mounted part 134 of the hood member 122 and the slides 210 of the cover member 204 are slid and moved so that the projected parts 138 formed in the ribs 136 of the cover member-mounted part 134 of the hood member 122 and the projected parts 212 formed in the slides 210 of the cover member 204 are locked. Furthermore, the locking protrusive parts 223 formed in the slides 210 are locked in the hood member 122 (see FIGS. 8A to 9C, and 12A to 12C).

Figure 13A:
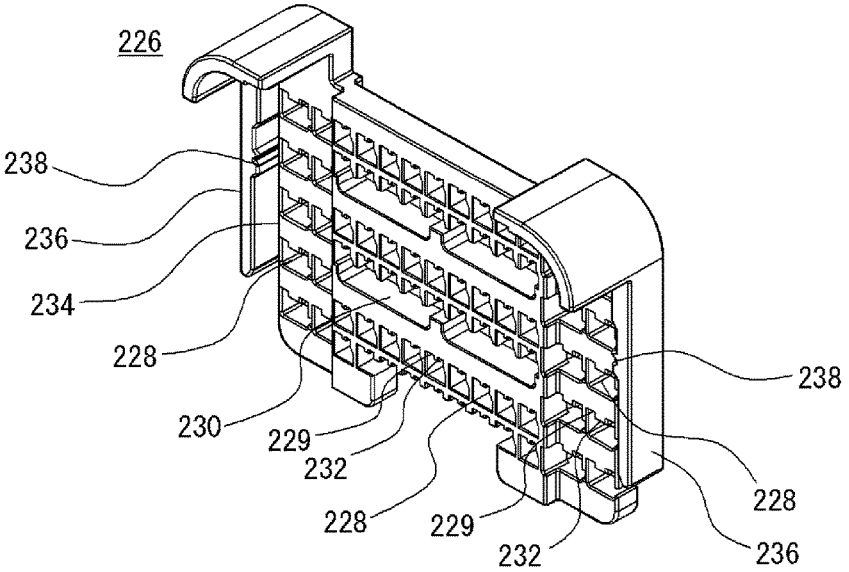
FIG. 13A is a perspective view of a retainer.
Figure 13B:
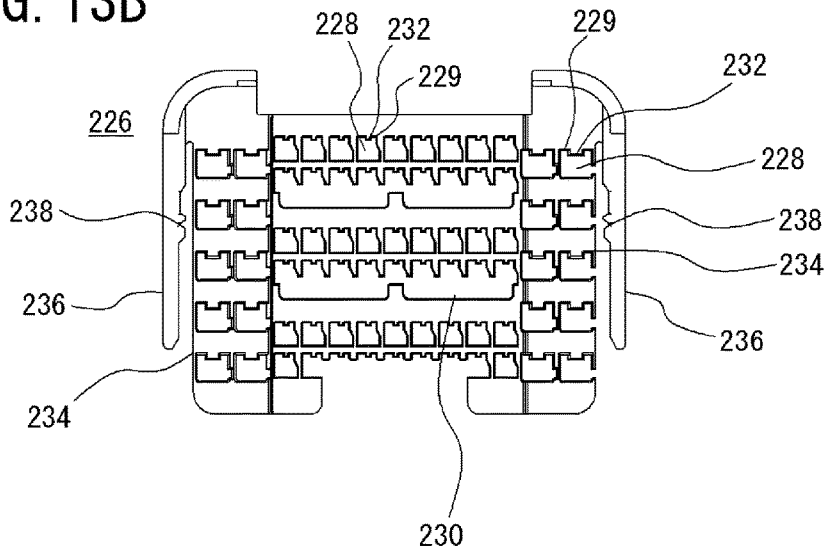
FIG. 13B is a front view of the retainer.
Figure 14B:
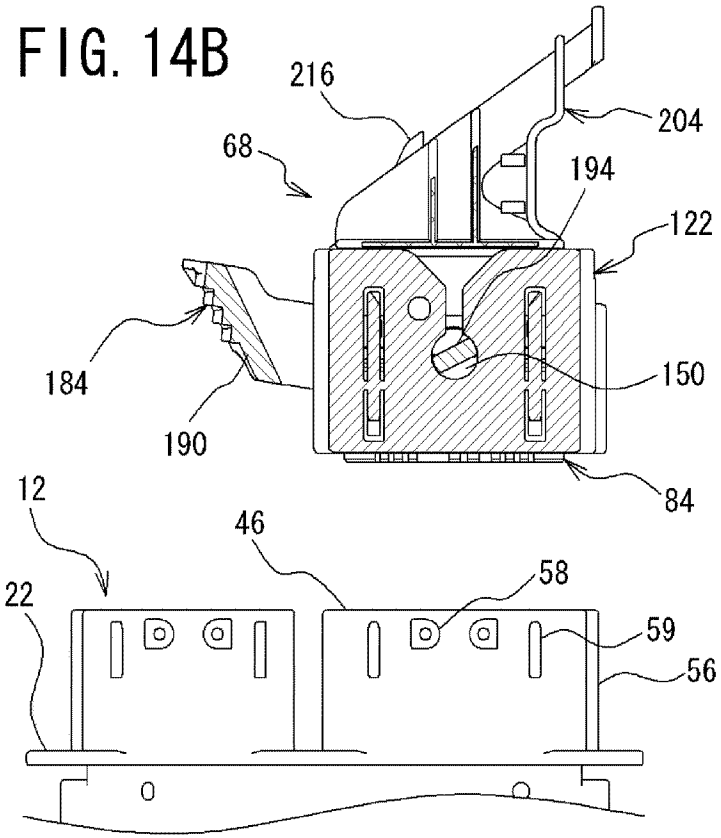
FIG. 14B is a cross sectional view taken along the line XIVB-XIVB in FIG. 1B.
Figure 14A:
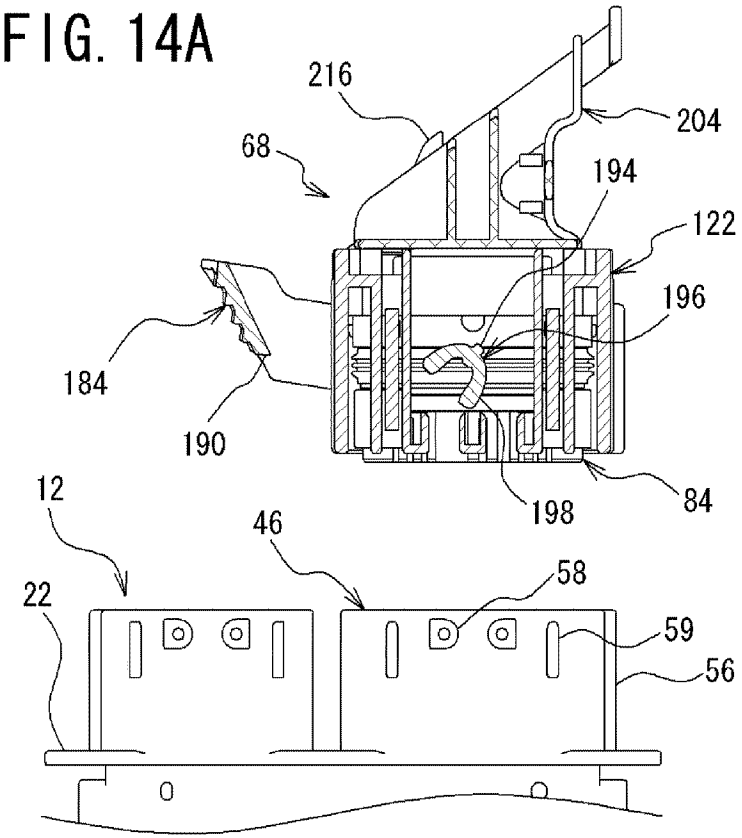
FIG. 14A is a cross sectional view taken along the line XIVA-XIVA in FIG. 1B.

Next, the retainer 226 will be described with reference to FIGS. 13A and 13B. The retainer 226 includes a plate-like body having a predetermined thickness. The retainer 226 is formed with contact-penetrated holes 228 to be penetrated by the plurality of second contacts 70; and a plurality of guided plate-penetrated holes 230 to be penetrated by the guided plates 60 formed in the first housing 22 of the first connector member 12.

A fixing protrusion 232 is formed in an upper part 229 of each contact-penetrated hole 228. Each fixing protrusion 232 is to be fitted with the fixed part 83 formed in each second contact 70.

A pair of mounting members 236 is formed in both side parts 234, 234 of the retainer 226. An inner part of each mounting member 236 is formed with a rib-for-locking 238 to be locked with the retainer-locking protrusion 118 (see FIGS. 7A and 7B) formed in each of one and the other second side surfaces 114, 116 of the second housing 84.

Before equipping the second housing 84 with the second contacts 70, the retainer 226 is inserted into the retainer-equipped groove 110. After containing the second contacts 70 in the second contact-containing unit 120 of the second housing 84, the retainer 226 is pressed so that the fixing protrusions 232 of the retainer 226 are fitted with the fixed parts 83 formed in the second contacts 70 and that the second contacts 70 are positioned and fixed.

As illustrated in FIG. 5, the seal member 240 is formed in an annular shape by an elastic member having elasticity such as rubber. The seal member 240 is to be mounted on a seal member-equipped part 121 (see FIGS. 7A and 7B) in the periphery of the second housing 84. When connecting the first and second connector members 12, 68, the seal member 240 is stuck fast inside the fitting unit 46 of the first housing 22 so as to perform as a waterproof member.

Next, the connection between the first and second connector members 12, 68 will be described with reference to FIGS. 1A, 1B, and 14A to 19D.

The first and second connector members 12, 68 will be connected in the following process. First, as illustrated in FIGS. 1A, 1B, 14A, and 14B, the first and second connector members 12, 68 which are to be connected are disposed, corresponding to each other. On this occasion, the outer guided part 56 formed in one side 50, closer to one side surface, of the fitting unit 46 of the first housing 22 of the first connector member 12 is disposed so as to correspond with the fitting unit-guiding groove 168 formed in one side face 166 of the hood member 122 of the second connector member 68. In such manners, the reverse connection of the second connector member 68 can be avoided.

Figure 15B:
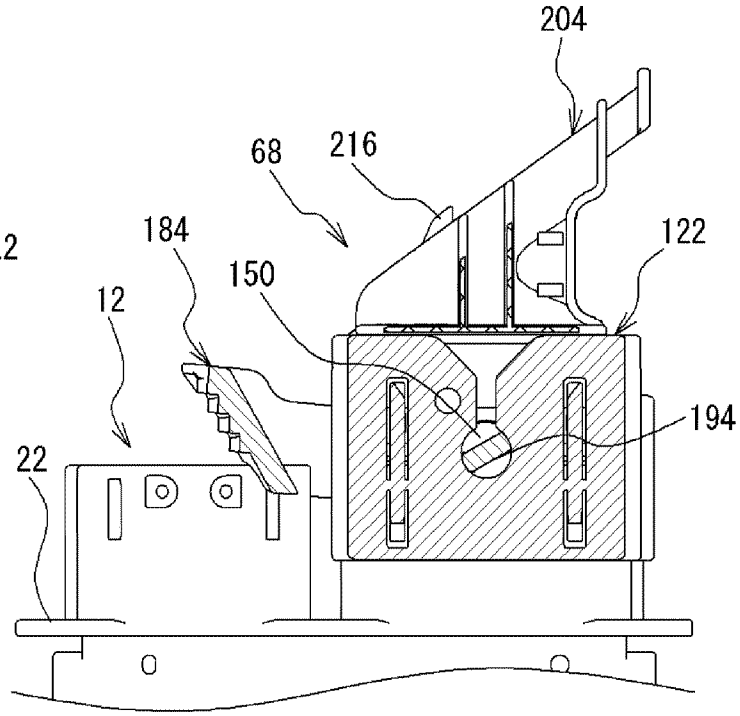
FIG. 15B is a cross sectional view following FIG. 14B.
Figure 15A:
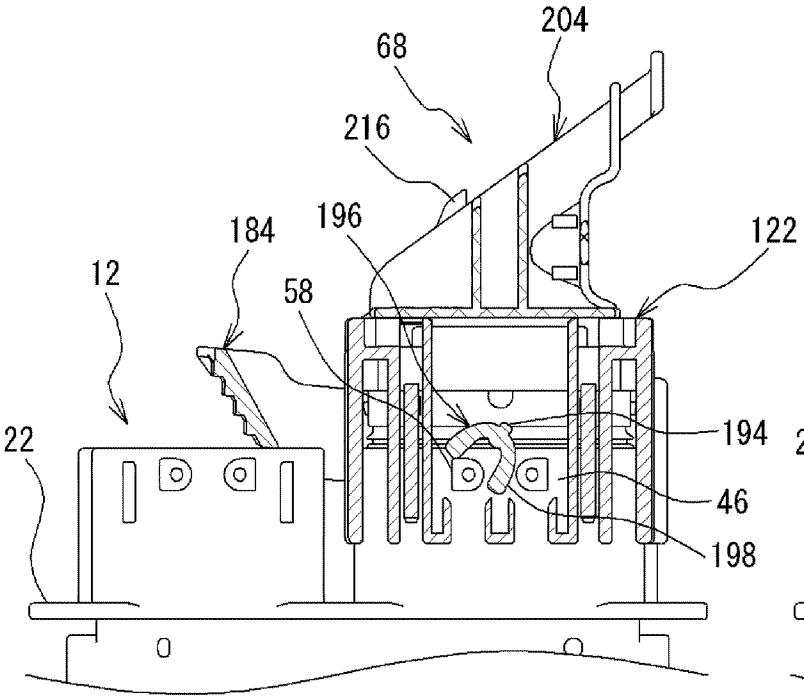
FIG. 15A is a cross sectional view following FIG. 14A, explaining the connection between the first and second connector members.

Next, as illustrated in FIGS. 15A and 15B, the second connector member 68 is inserted into the fitting unit 46 of the first connector member 12. On this occasion, the fitting unit 46 of the first connector member 12 is inserted into the space 173 between the second housing 84 of the second connector member 68 and the hood member 122. Furthermore, in this insertion, a plurality of inner guided parts 54 formed in inner parts of the sides 48, 52, 50, 50 of the fitting unit 46 closer to the top, bottom, and one and the other side surfaces is introduced to the guiding grooves 108 formed in the second top, second bottom, one and the other second side surfaces 106, 112, 114, 116 of the second housing 84. Furthermore, the first contacts 14 protruded from the first front surface 26 of the first housing body 24 inside the fitting unit 46 and the guided plates 60 formed in the first front surface 26 are respectively inserted into the first contact-inserted parts 88 and guiding holes 90 formed in the second front surface 86 of the second housing 84. After inserted from the first contact-inserted parts 88 of the second housing 84, note that the first contacts 14 are brought into contact with the second contacts 70 contained in the second contact-containing unit 120 of the second housing 84.

Furthermore, in this insertion, the outer guided part 56 formed in the periphery of one side surface 50 of the fitting unit 46 is guided to the fitting unit-guiding groove 168 formed inside one side face 166 of the hood member 122 of the second connector member 68. Then, each protrusion 58 formed in the sides 48, 52 of the fitting unit 46 closer to the top and bottom surfaces passes through each passage groove 146 formed inside the top and bottom faces 142, 144 of the hood member 122, and each protruded part-pressing protrusion 59 formed in the periphery of the sides 48, 52 of the fitting unit 46 closer to the top and bottom surfaces is moved along each guiding rail part 148 formed inside the top and bottom faces 142, 144 of the hood member 122.

On this occasion, as the protruded part-pressing protrusions 59 press the protruded parts 164 disposed inside the guiding rail parts 148, the rod-like bodies 162 formed with the protruded parts 164 are rotated around each supporting point 160 so as to push down the lever member-locking protrusions 158 disposed in the top and bottom faces 142, 144 of the hood member 122, formed in sides opposite to the protruded parts 164 of the rod-like bodies 162. Accordingly, the lock of the lever member 184 is released.

Furthermore, on this occasion, one of the protrusions 58 formed in the side 48 closer to the top surface and one of the protrusions 58 formed in the side 52, closer to the bottom surface, of the fitting unit 46 of the first connector member 12 are brought into contact with the claw-shaped parts 196 of the lever member 184 of the second connector member 68.

Figure 16B:
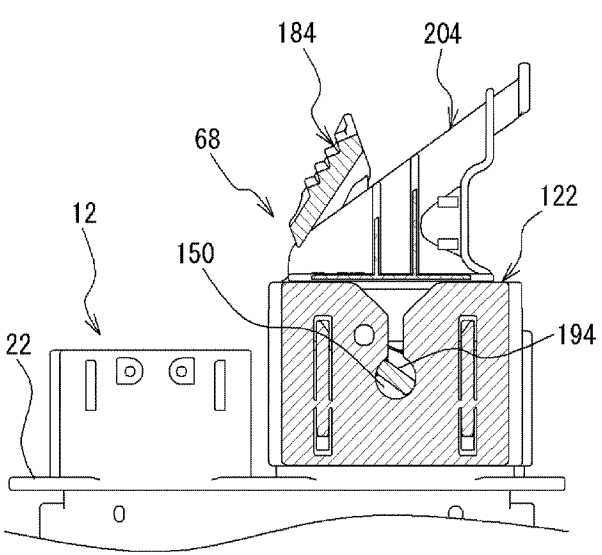
FIG. 16B is a cross sectional view following FIG. 15B.
Figure 16A:
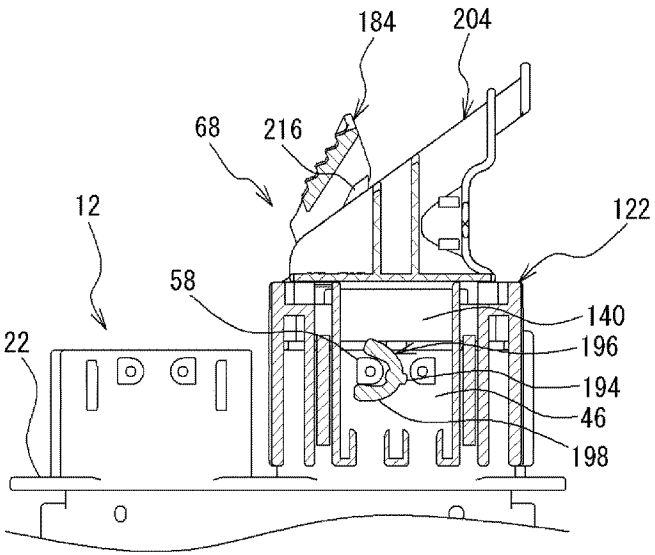
FIG. 16A is a cross sectional view following FIG. 15A, explaining the connection between the first and second connector members.

Next, as illustrated in FIGS. 16A and 16B, the lever member 184 of the second connector member 68 is rotated. After the claw-shaped parts 196 of the lever member 184 and the protrusions 58 of the fitting unit 46 are locked by rotating this lever member 184, the claw-shaped parts 196 are moved, drawing the protrusions 58 toward the second connector member 68 so that the first and second connector members 12, 68 are moved in a direction in which both connector members come close to each other, that is, in a direction in which both connector members are connected to each other.

The protrusions 58 are drawn by the claw-shaped parts 196 of the lever member 184 by the following process. That is, one of the claw members 198 of each claw-shaped part 196 hooks each protrusion 58 and the claw-shaped parts 196 are rotated around the shafts 194 of the lever member 184 so that the claw members 198 press the protrusions 58 along a rotating direction. On this occasion, each protrusion 58 is to be disposed in the drawing part 200 of each claw-shaped part 196 of the lever member 184.

Figure 17B:
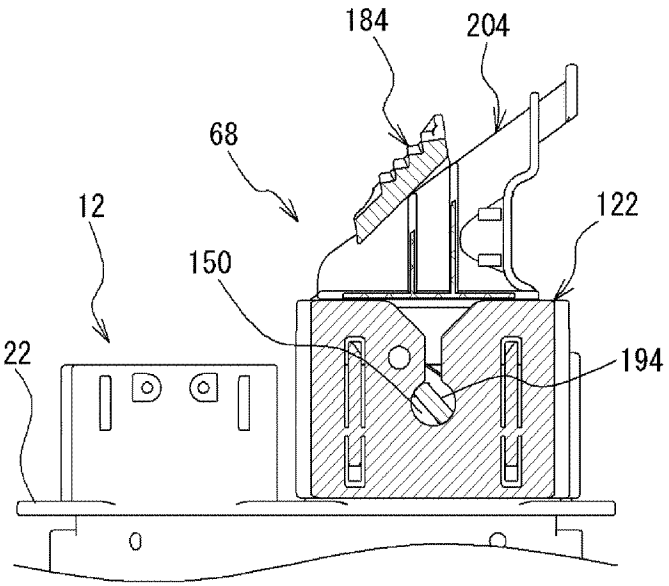
FIG. 17B is a cross sectional view following FIG. 16B.
Figure 17A:
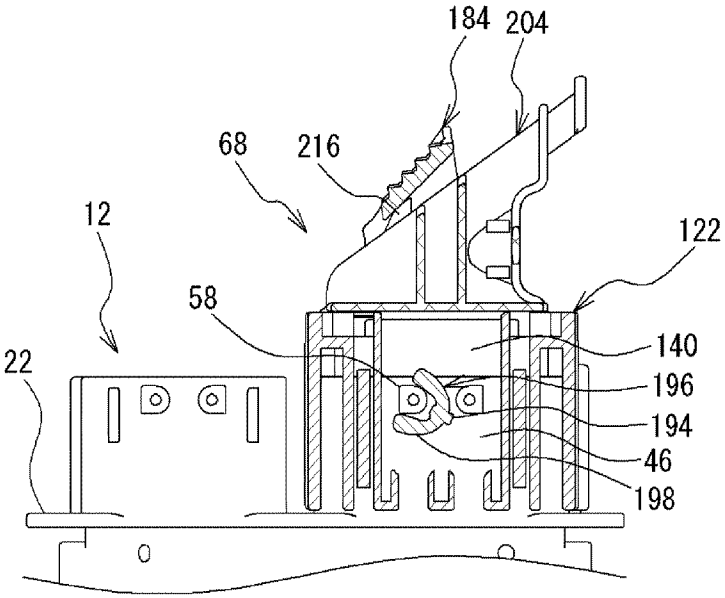
FIG. 17A is a cross sectional view following FIG. 16A, explaining the connection between the first and second connector members.
Figure 18B:
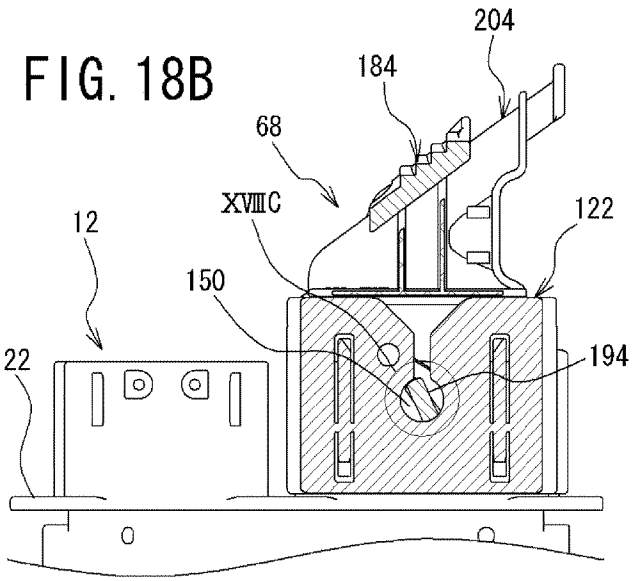
FIG. 18B is a cross sectional view following FIG. 17B.
Figure 18C:
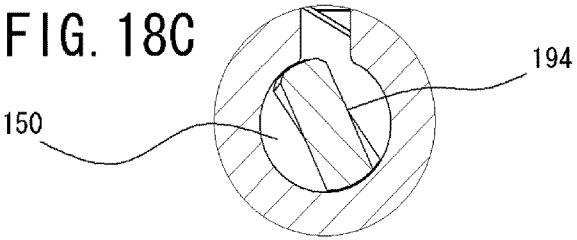
FIG. 18C is an enlarged view of a part XVIIIC illustrated in FIG. 18B.
Figure 18A:
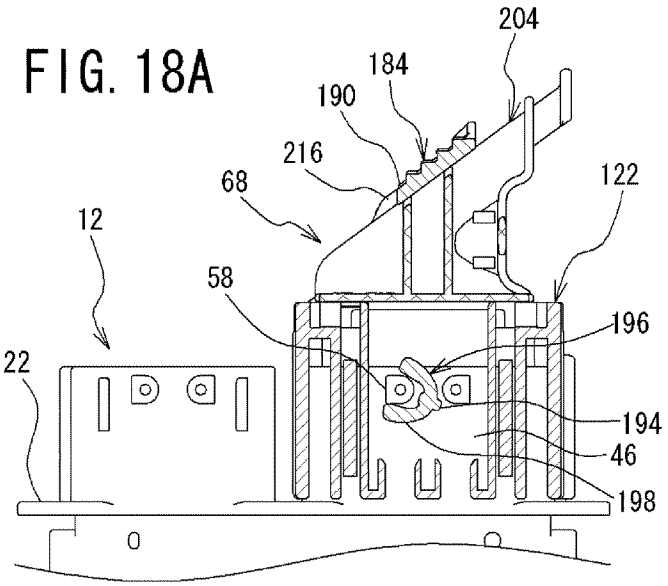
FIG. 18A is a cross sectional view following FIG. 17A, explaining the connection between the first and second connector members.

As illustrated in FIGS. 17A and 17B, the lever member 184 is then further rotated so that the protrusions 58 of the fitting unit 46 are drawn by the claw-shaped parts 196 of the lever member 184 of the second connector member 68. Accordingly, the first connector member 12 further approaches the second connector member 68, and the first and second housings 22, 84 are brought into contact with each other.

Figures 19A, 19B, 19C, 19D:
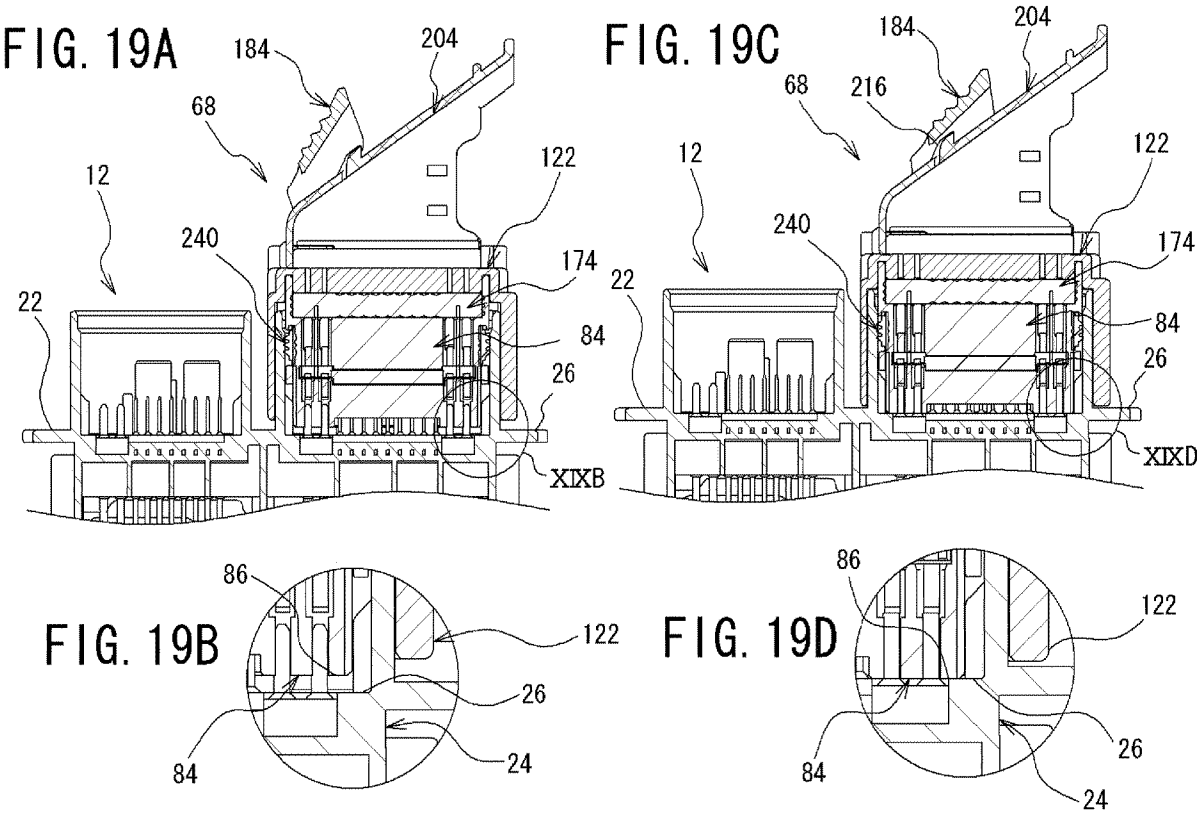
FIG. 19A is a cross sectional view, corresponding to FIG. 16A, taken along the line XIXA-XIXA in FIG. 1B.
FIG. 19B is an enlarged view of a part XIXB illustrated in FIG. 19A.
FIG. 19C is a cross sectional view following FIG. 19A, corresponding to FIG. 17A.
FIG. 19D is an enlarged view of a part XIXD illustrated in FIG. 19C.

In other words, in regard to the first housing 22 of the first connector member 12 and the second housing 84 of the second connector member 68, the first front surface 26 comes close to the second front surface 86 as illustrated in FIGS. 19A and 19B. The first front surface 26 of the first housing body 24 of the first connector member 12 is then brought into contact with the second front surface 86 of the second housing 84 of the second connector member 68 as illustrated in FIGS. 19C and 19D so that the movement thereof is restrained.

On this occasion, the lever member 184 of the second connector member 68 is not fixed so that there is still a distance for the lever member 184 to move until the lock unit 190 of the lever member 184 and the protrusive lock 216 of the cover member 204 are locked.

As illustrated in FIGS. 18A to 18C, and FIGS. 19C and 19D, the lever member 184 is then further rotated in a state where the first housing 22 of the first connector member 12 is brought into contact with the second housing 84 of the second connector member 68 and where the movement there of is restrained. Then, the lock unit 190 formed in the operation part 186 of the lever member 184 is locked in the protrusive lock 216 formed in the cover member 204 so as to fix the lever member 184.

On this occasion, even when the lever member 184 is rotated, the first and second connector members 12, 68 cannot be moved so that the lever member 184 itself, or herein, the shafts 194 of the lever member 184 are twisted and elastically deformed. Accordingly, the lever member 184 can be moved, and the shafts 194 of the lever member 184 are locked in and fixed with the cover member 204 in a state where the shafts 194 are twisted and elastically deformed (see FIG. 18C).

Therefore, the first and second connector members 12, 68 are fixed, having elasticity due to the twist and elastic deformation of the shafts 194 of the lever member 184 so that there is constant pushing force in the direction in which the first and second connector members 12, 68 are connected to each other, that is, force to bring the first connector member 12 close to the second connector member 68, which leads to restraint of flaws such as wobbles.

Note that the connection between the first contacts 14 provided to the first connector member 12 herein and the second contacts 70 provided to the second connector member 68 herein is to be carried out by the first contacting parts 18 (18*a*, 18*b*) of the first contacts 14 being gradually inserted into the second contacted parts 74 (74*a*, 74*b*) of the second contacts 70 in accordance with the connection between the first and second connector members 12, 68.

Accordingly, the connection between the first and second connector members 12, 68 is completed. Note that the connection between the first and second connector members 12, 68 can be easily released by taking off the lock unit 190 of the lever member 184 from the protrusive lock 216 of the cover member 204.

Herein, note that the shafts 194 of the lever member 184 are formed in a plate-like shape, but it should not be restricted thereto. Shafts may be formed in a rod-like shape such as a columnar shape, and prismatic shape. In such a case, penetrated grooves formed in a hood member are deformed in accordance with the shape of the shafts.

Herein, the elasticity is obtained by the twist of the shafts 194 of the lever member 184, but it should not be restricted thereto. Elasticity may be obtained by deformation of arms or claw-shaped parts.

Herein, in regard to the first front surface 26 of the first housing body 24 of the first connector member 12 and the front face 124 of the hood member 122 of the second connector member 68, they are not restricted to be brought into contact with each other through a surface of the front face 124 of the hood member 122. For example, a protrusion may be formed in a front face 124 of a hood member 122 and the protrusion may be brought into point-contact with a first housing body 24.

Furthermore, the lever member 184 herein has been illustrated that it is formed of a resin material, but it should not be restricted thereto. For example, the lever member 184 may be formed of a material elastically deformable and having elasticity such as a metallic material.

What is claimed is:

1. A connector, comprising:

a first connector member; and a second connector member, wherein the first connector member and the second connector member are connected to each other, the first connector member being formed with one or more protrusions, and the second connector member including a lever member rotatably provided to the second connector member, wherein the lever member has an arm, a claw-shaped part configured to lock the protrusions formed in the first connector member, and a shaft linking the arm with the claw-shaped part, wherein when connecting the first connector member and the second connector member, the lever member is rotated so that the protrusions locked in the claw-shaped parts of the lever member are drawn in a connecting direction, and the first connector member and the second connector member are moved in the connecting direction and at least partially brought into contact with each other, and wherein after the movement of the first connector member and the second connector member is restrained, the lever member is further rotated so that the lever member is fixed in a manner so that the first and second connector members having elasticity maintained therebetween while the shaft of the lever member is twisted and elastically deformed thereby a force bringing the first connector member close to the second connector member is generated.

2. The connector according to claim 1, wherein the lever member includes a lock unit configured to be fixed in the second connector member, and wherein when the first connector member and the second connector member are brought into contact with each other, the lock unit of the lever member is disposed in a position separated from a position where the lock unit is to be fixed in the second connector member, and the lever member is further rotated and elastically deformed so that the lock unit is fixed in the second connector member.

3. The connector according to claim 1, wherein the first connector member includes a first housing body; and a fitting unit protruded from the first housing body, having a tubular shape, and formed in a surface where each protrusion faces the second connector member, wherein the second connector member includes a second housing; and a hood member configured to cover the second housing, and wherein when the first connector member and second connector member are connected, the first housing body and the second housing are at least partially brought into contact with each other so that the fitting unit of the first housing body is fitted in a space between the second housing and the hood member.

4. The connector according to claim 3, wherein the lever member includes:

an operation part formed with the lock unit, having a predetermined length;

a pair of arms stretching from both ends of the operation part;

a shaft disposed in each of the pair of arms; and a claw-shaped part disposed in each shaft, and wherein the shafts of the lever member are rotatably provided to bearings configured to penetrate opposing surfaces of the hood member, and the claw-shaped parts are disposed in spaces formed between the second housing and the hood member.

* * * * *